US006500072B1

(12) United States Patent
Myers et al.

(10) Patent No.: US 6,500,072 B1
(45) Date of Patent: Dec. 31, 2002

(54) HEIGHT ADJUSTABLE SWING FOR AN INFANT OR CHILD

(75) Inventors: Peter J. Myers, Wheaton, IL (US); Carl Stern, Pennington, NJ (US); Andrew Weiman, Newtown, PA (US)

(73) Assignee: Kolcraft Enterprises, Inc., Chicago, IL (US)

( * ) Notice: Subject to any disclaimer, the term of this patent is extended or adjusted under 35 U.S.C. 154(b) by 20 days.

(21) Appl. No.: 09/687,591

(22) Filed: Oct. 13, 2000

(51) Int. Cl.[7] ..... A63G 9/16

(52) U.S. Cl. ..... 472/119; 472/118; 297/273

(58) Field of Search ..... 472/118, 119, 472/120, 121, 122, 123, 124, 125; 297/344.12, 344.18, 273, 277, 278

(56) References Cited

U.S. PATENT DOCUMENTS

| | | | | |
|---|---|---|---|---|
| 2,525,377 A | | 10/1950 | Schwartz | 472/121 |
| 2,797,738 A | | 7/1957 | Patterson | 297/344.18 |
| 4,324,432 A | | 4/1982 | Eldon, III et al. | 297/377 |
| 4,325,578 A | | 4/1982 | Borucki | 297/281 |
| 4,452,446 A | | 6/1984 | Saint | 272/86 |
| 4,589,657 A | | 5/1986 | Saint | 272/85 |
| 4,807,872 A | | 2/1989 | Spilman et al. | 272/86 |
| 4,822,033 A | | 4/1989 | Kohus et al. | 472/119 |
| 4,940,229 A | | 7/1990 | Foster | 472/119 |
| 5,083,773 A | | 1/1992 | Saint | 272/86 |
| 5,326,327 A | | 7/1994 | Stephens et al. | 471/119 |
| D351,289 S | | 10/1994 | Stephens et al. | D6/344 |
| D359,857 S | | 7/1995 | Bartlett | D6/347 |
| D368,816 S | | 4/1996 | Mitchell et al. | D6/500 |
| 5,525,113 A | | 6/1996 | Mitchell et al. | 472/119 |
| 5,533,936 A | | 7/1996 | Julien et al. | 472/118 |
| 5,628,689 A | | 5/1997 | Saint et al. | 472/118 |
| D392,126 S | | 3/1998 | Sack | D6/491 |
| 5,769,727 A | | 6/1998 | Fair et al. | 472/118 |
| 5,791,999 A | | 8/1998 | Lauro et al. | 472/118 |
| 5,803,817 A | | 9/1998 | Stern | 472/118 |
| 5,833,545 A | * | 11/1998 | Pinch et al. | 297/273 |
| 5,846,136 A | * | 12/1998 | Wu | 472/119 |
| 6,022,277 A | | 2/2000 | Jankowski | 472/119 |
| 6,010,410 A | | 4/2000 | Lauro et al. | 472/118 |
| 6,251,023 B1 | | 6/2001 | Lauro et al. | 472/118 |

OTHER PUBLICATIONS

Advertisement displaying Graco's Advantage™ baby swing, Model 1452ND, Navy Dot (undated).

Advertisement displaying Graco's Advantage™ baby swing, Model 1452MW, Milky Way (undated).

Brochure (p. 3) displaying Kolcraft's Lil' Swinger™ infant swing, Model 14902–EJ, 1993.

* cited by examiner

*Primary Examiner*—Kien T. Nguyen
(74) *Attorney, Agent, or Firm*—Marshall, Gerstein & Borun

(57) ABSTRACT

A swing for an infant or child is disclosed. The swing includes a frame; a first support arm suspended for swinging movement relative to the frame; and a seat. The swing also includes a support bar coupled to the seat. The support bar has a first end. The first end of the support bar telescopes with the first support arm such that the seat can be moved between a first height and a second height.

35 Claims, 18 Drawing Sheets

100
140
139
138
128
116
162
114
112
300
111
118
122
139
140
138
128
116
193
120
122
122
114
122

252
V MOTOR +
280
SPEED ADJUST 1K
V MOTOR -
250
R7 6.49K
286
U3
14
10
11
12
R6 200K
288
7
3
5
4
R8 4.99K
U3 TC74HC4066 (DIP14)
SWITCH CONTACTS
294
FAST
R5 8.06K
282
8
9
6
R4 200K
284
2
13
1
R9 5.23K
290
SHORTING WIPER
292
SLOW
C1 100uf 16v
276
U2
LM358N
2SAB86R (TO-126b)
Q1
R3 100Ω
C2 .1uf
R2 1K
274
R1 1.5K
277
218
U1 LM385Z-1.2 (TO92)
V BATT+
V BATT -

HEIGHT ADJUSTABLE SWING FOR AN INFANT OR CHILD

FIELD OF THE INVENTION

The invention relates generally to swings, and, more particularly, to a height adjustable swing for an infant or child.

BACKGROUND OF THE INVENTION

Infant swings of various types are presently available on the market. One type of infant swing is an open top swing which, as its name suggests, does not include a bar or housing member above and across the seat. This opening above the seat facilitates inserting/removing an infant to/from the swing. Open top swings generally include a base or frame member which is disposed on the ground surface. A swing assembly is connected to and depends from the frame. The swing assembly is adapted to pivot relative to the frame assembly. The desired swinging movement is generated either manually or by a drive motor.

While such swing assemblies are generally satisfactory, certain disadvantages exist. It has been found that, in some instances, when an infant is placed in the swing assembly, a mother or other child care provider is concerned because the drive motor will cause the swing to travel over too great an arc or because the instantaneous speed of the swing is too rapid for the particular child in the swing seat.

Moreover, it is sometimes desired to position the infant who is located in the swing further off the ground so that the child is positioned closer to a mother for feeding and the mother does not have to bend over as far to place the child in the seat.

SUMMARY OF THE INVENTION

In accordance with an aspect of the invention, a swing for an infant or child is provided. The swing includes a frame; a first support arm suspended for swinging movement relative to the frame; and a seat. The swing also includes a support bar coupled to the seat. The support bar has a first end. The first end of the support bar telescopes with the first support arm such that the seat can be moved between a first height and a second height.

In accordance with another aspect of the invention, a swing is provided for an infant or child which includes a frame, and a first support arm suspended for swinging movement relative to the frame. The first support arm has a first longitudinal axis. The swing also includes a seat and a support bar coupled to the seat. The support bar slidably engages the first support arm such that the support bar is movable relative to the first longitudinal axis. Moving the support bar relative to the first longitudinal axis adjusts a height of the seat.

In accordance with yet another aspect of the invention, a swing for an infant or child is disclosed. The swing includes a frame and at least one support member suspended for swinging movement relative to the frame. The swing also includes a seat coupled to the at least one support member such that the scat can be tilted between an upright position and a reclined position. The seat is also movable between a first height and a second height. The swing is also provided with a clamp assembly cooperating with the at least one support member for selectively securing the seat in at least one of the first and second heights.

In accordance with another aspect of the invention, a swing is provided for an infant or child. The swing includes a frame; a first support arm suspended for swinging movement relative to the frame; and a seat suspended by the first support arm. The swing also includes a motor operatively coupled to the first support arm for swinging the first support arm and the seat. Additionally, the swing is provided with a control circuit coupled to the motor. The control circuit includes a power adjustment input for selecting the power output by the motor, and further includes a range input for selecting a range of power outputs selectable by the power adjustment input.

In accordance with still another aspect of the invention, a swing for an infant or child is provided. The swing includes a frame; a first support arm suspended for swinging movement relative to the frame; a seat suspended by the first support arm, the seat being movable between a first height and a second height; and a motor operatively coupled to the first support arm for swinging the first support arm and the seat. The swing also includes a control circuit coupled to the motor. T he control circuit permits selection of the power output by the motor within a first range when the seat is at the first height and permits selection of the power output by the motor within a second range when the seat is at the second height.

In accordance with another aspect of the invention, a swing is provided for an infant or child. The swing includes a frame; a first support arm suspended for swinging movement relative to the frame; a seat suspended by the first support arm; and a motor operatively coupled to the first support arm for swinging the first support arm and the seat. The swing also includes a control circuit coupled to the motor. The control circuit includes a power adjustment input for selecting the power output by the motor, and further includes a range input for selecting a range of power outputs selectable by the power adjustment input.

In accordance with still another aspect of the invention, a swing for an infant or child is provided which includes a frame and a first support arm suspended for swinging movement relative to the frame. The swing also includes a seat operatively coupled to the first support arm for swinging movement through a travel distance along a path. Additionally, the swing is provided with a support bar coupled to the seat. The support bar has a first end. The first end of the support bar telescopes with the first support arm to adjust the travel distance of the seat.

In accordance with another aspect of the invention, a swing for an infant or child is disclosed which swing includes a frame and a first support arm suspended for swinging movement relative to the frame. The first support arm has a first longitudinal axis. The swing is also provided with a seat operatively coupled to the first support arm for swinging movement through a travel distance along a path. Moreover, the swing includes a support bar coupled to the scat. The support bar slidably engages the first support arm such that the support bar is movable relative to the first longitudinal axis. Moving the support bar relative to the first longitudinal axis adjusts the travel distance of the seat.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
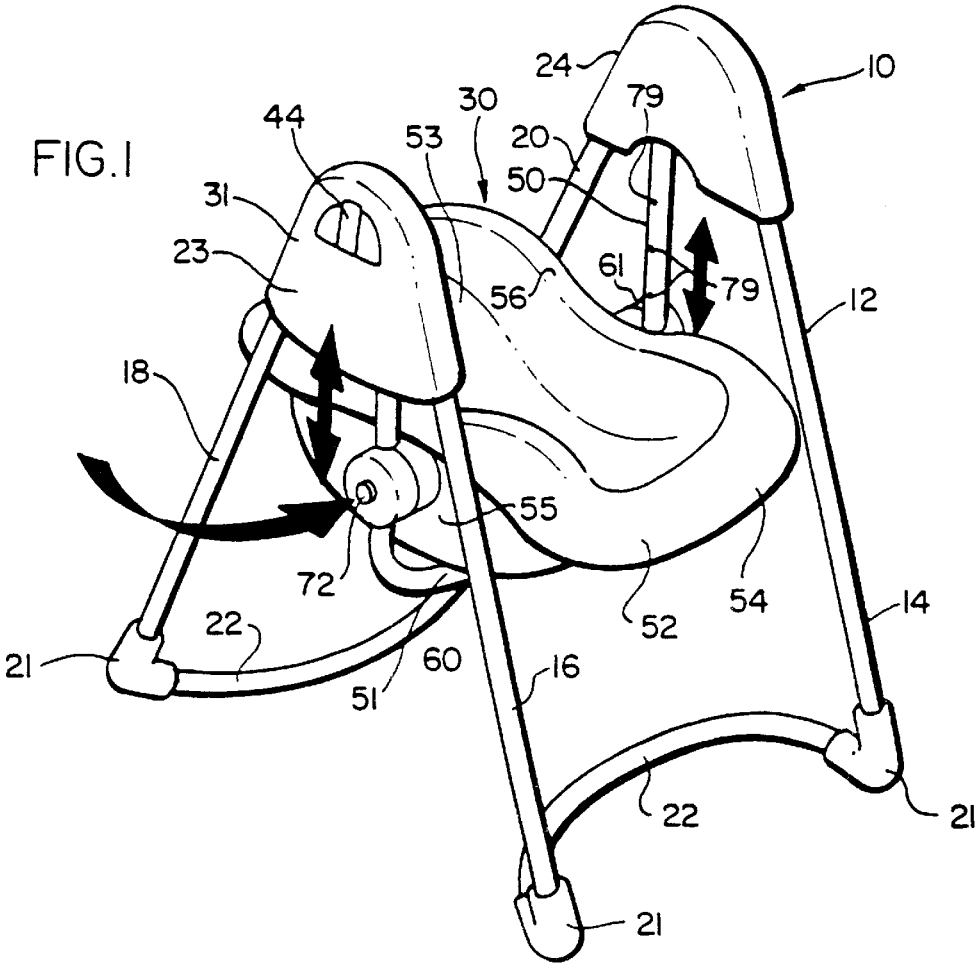
FIG. 1 shows a perspective view of an open top swing with the swing disposed in one position relative to a pair of pivot pins about which the swing rotates.

Referring to the drawings, FIG. 1 illustrates an open top swing 10 utilized to hold a young infant or child. Swing 10 includes a frame 12 which comprises plastic or metal tubular frame legs 14, 16, 18 and 20. The bottom end of each leg 14, 16, 18, 20 is fastened to one end of a respective connector 21. The remaining end of each connector 21 is fastened to a respective curved base member 22. Each of the two base members 22 are adapted to seat on the ground surface to support and stabilize the swing 10.

Frame legs 16 and 18 converge at their respective top leg ends and are mounted in a housing 23. Similarly, legs 14 and 20 converge at their respective top leg ends and are mounted in a housing 24. In the particular swing illustrated in FIG. 1., the housing 23 also serves to house a swing motor which, when actuated, drives a swing assembly 30 through arcuate motion. If desired, a motor also can be incorporated into the housing 24.

Figure 2:
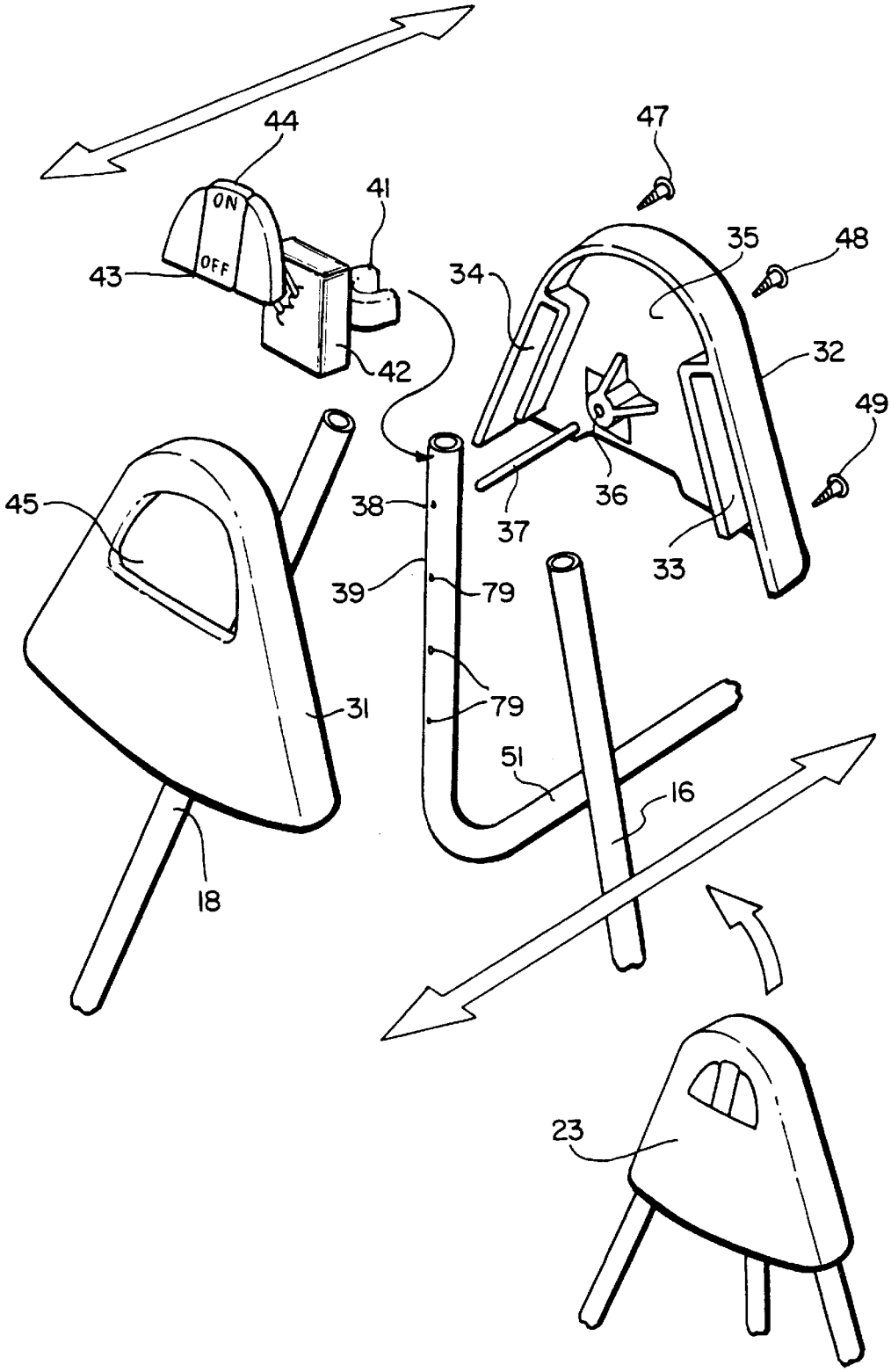
FIG. 2 shows an exploded, fragmentary view of one of two swing mounting housings and the associated swing parts of the swing of FIG. 1.

Referring more particularly to FIG. 2, there is shown an exploded view of motor housing 23 and swing assembly 30. Housing 23 includes an outer housing shell 31 and an inner housing shell 32. The top end of the frame leg 16 is adapted to seat in a shell recess 33 and the top end of the frame leg 18 is adapted to seat in a shell recess 34. A pivot pin mounting member 36 extends outwardly from an inner surface 35 of the inner shell 32. The mounting member 36 is adapted to receive and support one end of a pivot pin 37.

The remaining end of the pivot pin 37 is adapted to pass through both an opening 38 in a seat support leg 39 (to be described) and an opening, not shown, in pin bushing 41 where it connects to a conventional swing drive motor 42. Motor 42 is maintained against motor actuated button member 43 which is located in a recess in the outer housing shell 31. The "on" and "off" button 44 of the member 43 is located within the housing opening 45. Swing actuator motor 42 may be any conventional motor presently utilized to rotate a drive shaft or pivot member of a swing assembly. If desired, motor 42 could be eliminated and a pivot pin mounted within housing 23 whereby swing assembly 30 is pivoted manually relative to the frame.

Screws 47, 48, 49 are inserted in openings, not shown, in inner housing shell 32 and are screwed into corresponding threaded openings, not shown, in outer housing shell 31 to retain frame legs 16, 18 in housing 23. Housing assembly 24 utilizes the same components as housing assembly 23, except for the drive motor. Housing 24 also includes a pivot pin supported by housing shells from which seat support leg 50 depends. If desired, a drive motor also can be utilized with housing 24.

Swing assembly 30 includes a U-shaped tubular member comprising seat support base 51 and seat support legs 39 and 50 which normally extend upward from the outboard ends of base 51. Seat 52 is a molded plastic member and includes back portion 53, front portion 54 and side portions 55, 56.

Clamp assembly 60 is fastened to seat side portion 55 and another clamp assembly 61 is fastened to seat side portion 56. The clamp assemblies can be plastic molded members which are either molded as an integral part of seat 52 or the clamp assemblies, if desired, can be releasably fastened by suitable fastener means to the sides of seat 52.

Figure 3:
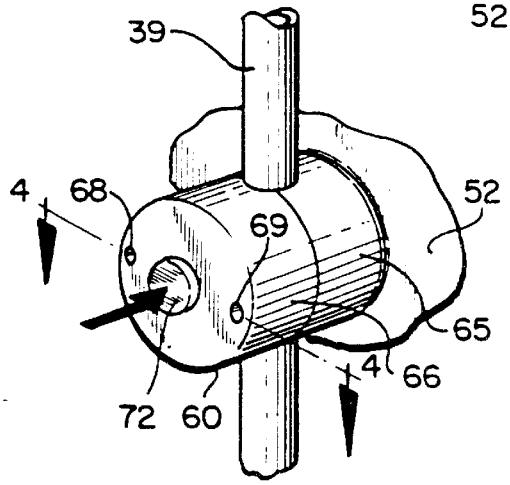
FIG. 3 shows an enlarged fragmentary view of one of the adjustable seat clamp assemblies of the swing of FIG. 1 for adjusting the seat to a desired height relative to the pivot pins.
Figure 4:
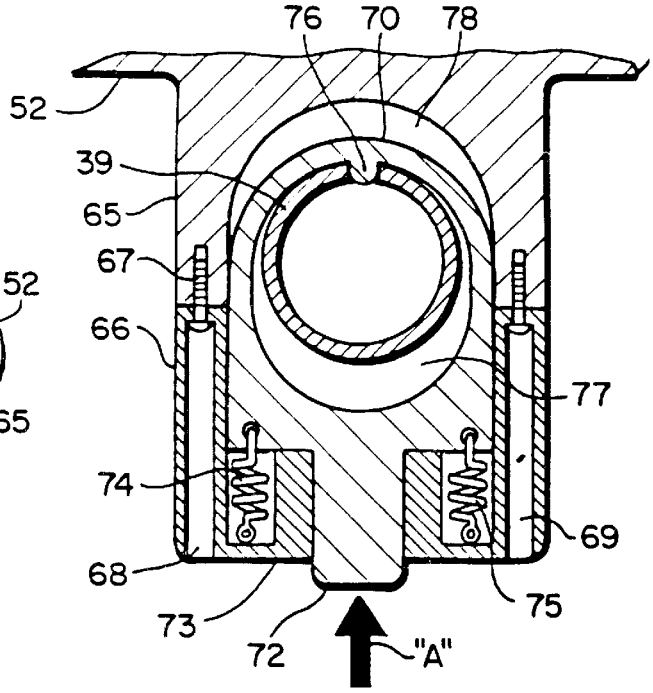
FIG. 4 shows a cross-section view taken along lines 4—4 in FIG. 3.

Referring to FIGS. 3 and 4, clamp assembly 60 includes clamp housings 65, 66. Inner housing 65 is integrally molded to seat 52. Outer clamp housing 66 is disposed to seat against housing 65 and is connected to housing 65 by means of threaded fasteners 67 which are adapted to enter fastener openings 68, 69 in housing 66 and screw into housing 65. A button member 70 is adapted to seat within corresponding recesses in clamp housing members 65, 66. Button 72 projects outward from button member 70. A pair of compression springs 74, 75 each have one spring end mounted to button member 70 while the remaining spring end is fastened to clamp housing 66. The springs serve to bias button member 70 in the direction opposite the direction of arrow "A" in FIG. 4 whereby button 72 normally extends beyond outer surface 73 of clamp housing 66.

Button member 70 also includes an oval shaped opening 77. A corresponding opening 78 is located in clamp housing 65. A detent 76 is located on member 70 and extends into the opening 77.

Seat support leg 39 is mounted in opining 77 while seat support leg 50 is mounted in a similar opening in clamp assembly 61 which is identical in structure to clamp assembly 60. Detent 76 is adapted to normally seat in one of the openings 79 in support legs 39, 50 thereby locking the clamp assemblies to the seat support legs. By pushing in on button 72 of the respective clamp assemblies, button members 70 are urged inwardly in the direction indicated by arrow "A" in FIG. 4 whereby detent 76 is removed from opening 79 and clamp assemblies 60, 61 arc in an unlocked position relative to the seat Support legs. Seat 52 is then capable of being moved up or down along the length of legs 39, 50 to another opening 79. If button 72 is then released, the button member 70 will return to its normal biased position and detent 76 will be positioned in a desired opening 79 whereby infant seat 52 is positioned at a desired height.

It will be appreciated that as the infant seat is moved upward and closer to the pivot pins, seat 52, upon actuation of drive motor 42, will travel an arcuate distance which is less than the arcuate distance traveled when swing seat 52 is located a greater distance away from the pivot pins. Moreover, when the seat 52 is positioned close to pivot pin 37, the swing speed is slower as opposed to the speed at which the swing seat travels when it is located contiguous to seat support base 51. As a result, a mother, parent or other operator is able to adjust both the arcuate swing distance an infant will travel as well as the speed of seat travel. Moreover, if it is desired to feed a child in the open swing of FIGS. 1–4, the seat can be adjusted to, and locked in, a fixed position contiguous to pivot pin 37 whereby access to the child can be achieved relatively easily.

The various components of the swing of FIGS. 1–4 can be made using any suitable plastic or metal materials utilized with open top swings presently available. Similarly, it will be appreciated by persons of ordinary skill in the art that clamp locking systems other than that shown in FIGS. 1–4 can be utilized to adjust the location of the swing seat relative to the pivot pins.

While two swing support legs have been utilized, a swing assembly could, if desired, utilize one seat support leg which would extend from one of the mounting housings.

Figure 5:
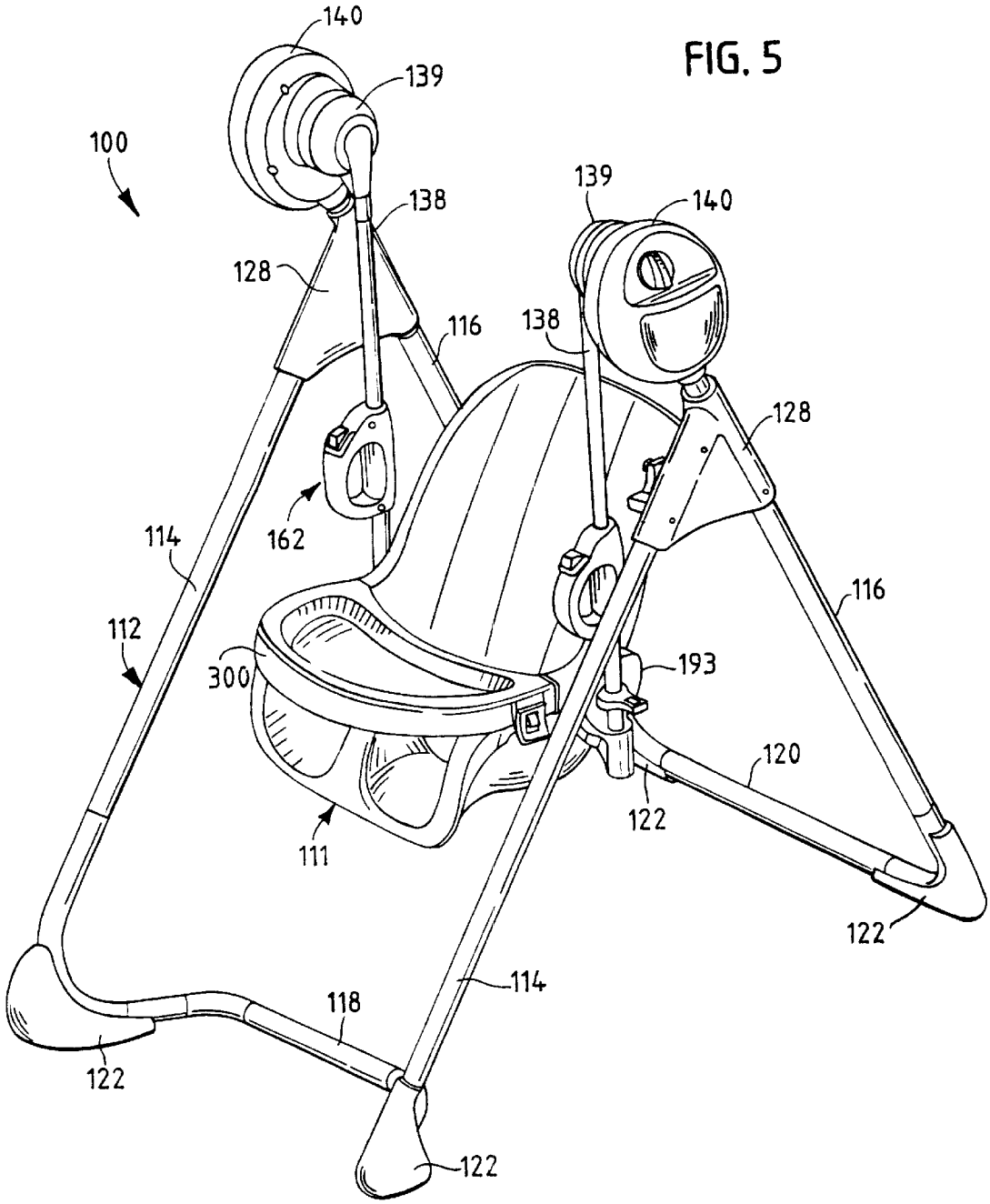
FIG. 5 is a right, front perspective view of an infant swing constructed in accordance with the teachings of the invention, and showing the seat of the swing in a lowered position.

A swing 100 constructed in accordance with the teachings of the invention is shown in FIG. 5. Like the swing 10 described above, the swing 100 is particularly designed for use with infants and young children. Also like the swing 10 described above, the swing 100 includes a frame 12 and a seat 111. The frame 112 of the swing 100 comprises two forward legs 114 and two rear legs 116. The forward legs 114 are joined by a cross-bar 118 which is positioned for disposition along a support surface such as a floor. The cross-bar 118 is preferably displaced inwardly from the lower distal ends of the forward legs as shown in FIG. 5.

Like the forward legs 114, the rear legs 116 are joined by a cross-bar 120 disposed along the support surface. To improve the stability of the frame 120, plastic support feet 122 are secured to the legs 114, 116 and cross-bars 118, 120 as shown in FIGS. 5 and 6.

Figure 6:
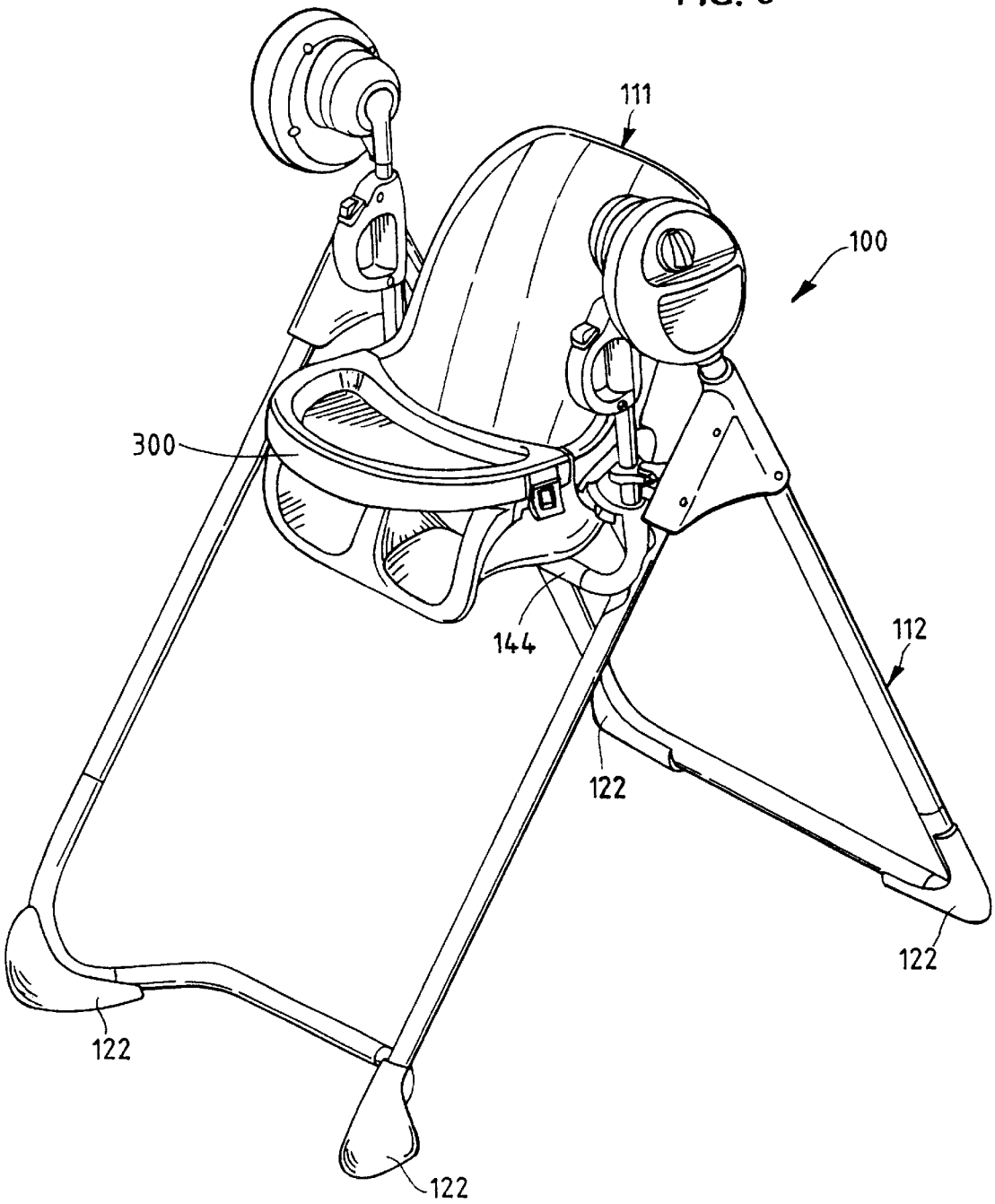
FIG. 6 is a view similar to FIG. 5, but showing the seat of the swing in a raised position.
Figure 11:
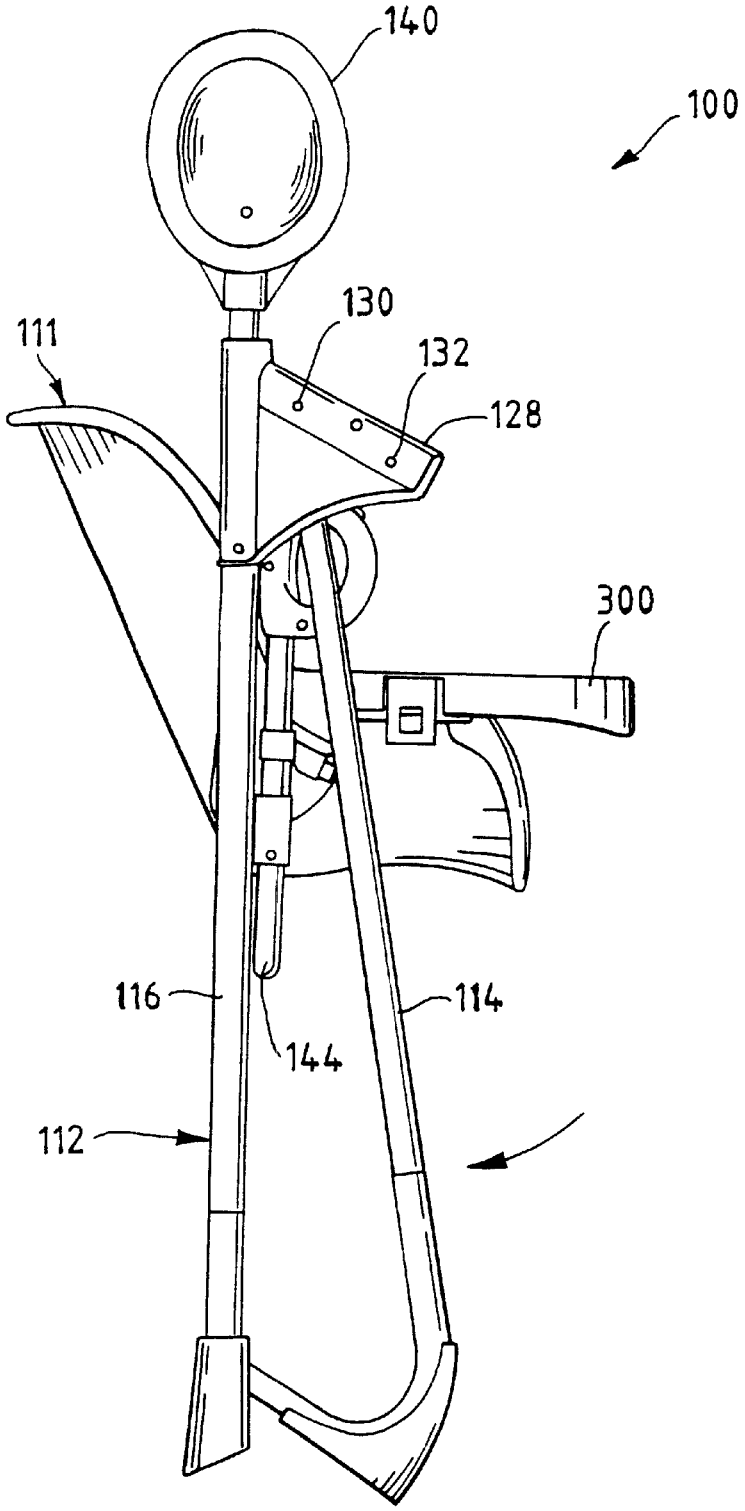
FIG. 11 is a view similar to FIG. 9, but showing the swing frame in a folded position.

As also shown in FIGS. 5 and 6, the upper ends of the legs 114, 116 are secured in plastic frame housings 128. Preferably, the rear legs 116 are fixed to their respective frame housings with bolts or rivets. The front legs 114 are preferably secured to their respective housing 128 such that the front legs 114 can be selectively pivoted inward to fold the frame (see FIG. 11). In the illustrated embodiment, this pivotable coupling is implemented by pivotably securing the legs 114 to their respective housings 128 via a bolt 130 (see FIG. 11) at a front location, and by providing the housings 128 with a bore 132 and the legs 114 with spring buttons (not shown but similar in structure and function to spring button 166 shown in FIG. 12) for selectively mating with the bores 132. When the buttons are seated in the bores 132, the frame 112 will not fold. When the buttons are forcibly displaced from the bores 132, the frame 112 can be folded by rotating the legs 114 about bolts 130 as shown in FIG. 11.

Figure 8:
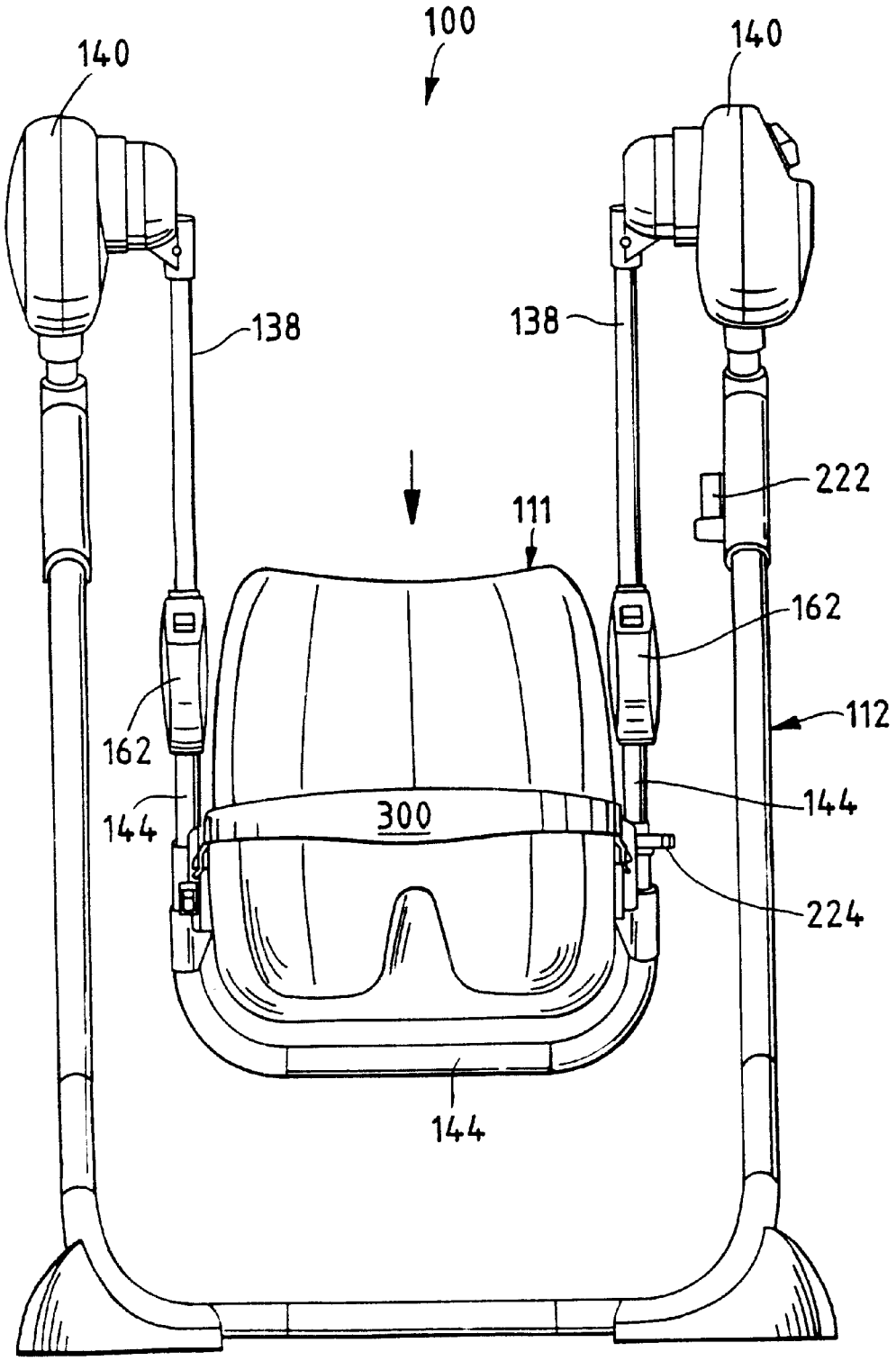
FIG. 8 is a view similar to FIG. 7 but showing the seat in the lowered position.

For the purpose of suspending the seat 111 for swinging movement through a preferably arcuate path, the swing 100 is further provided with support arms 138. As most easily seen in FIGS. 5 and 8, the support arms 138 are coupled to the frame 112 immediately above the housings 128 by swing pivots 139 and motor housings 140. Preferably, the support arms 138 are implemented by rigid, straight tubes each of which has a longitudinal axis. A first end of each support arm 138 is mounted to a respective one of the swing pivots 139.

Figure 12:
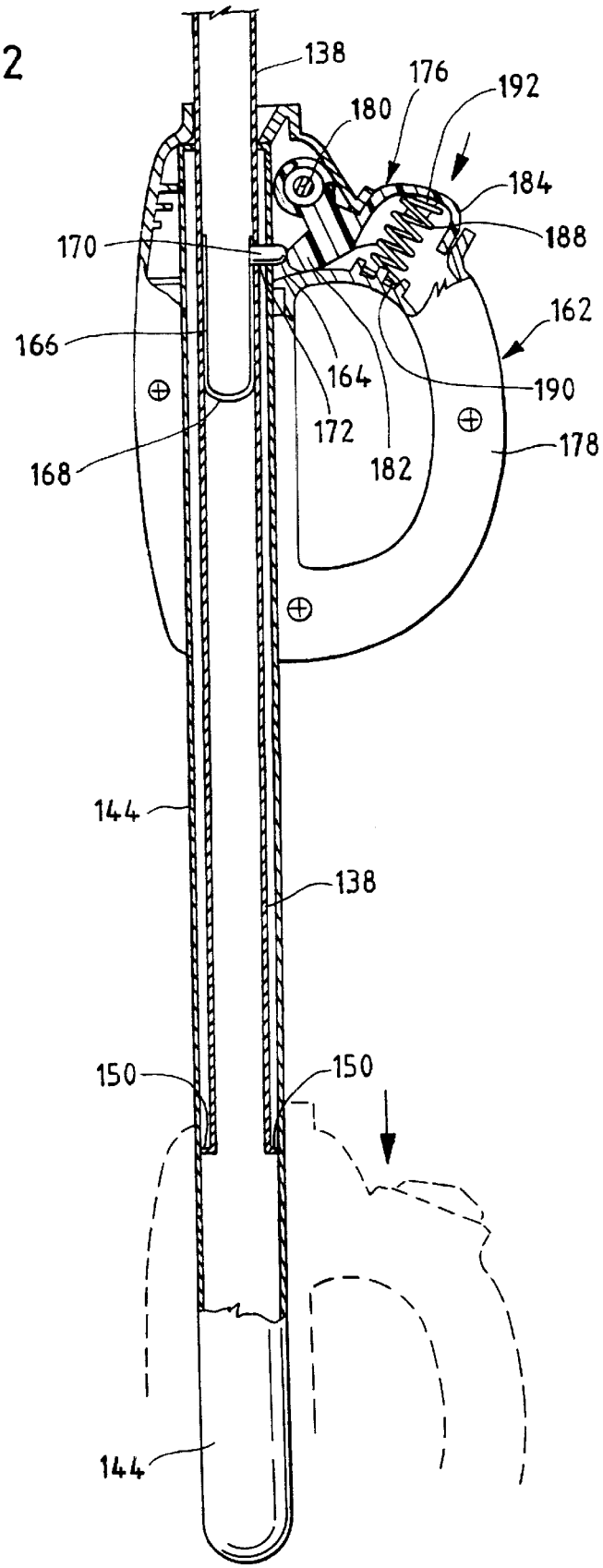
FIG. 12 is an enlarged, cross-sectional view of the telescoping seat support and height adjustment mechanism of the swing of FIG. 1.

To couple the support arms 138 to one another, to provide structural rigidity, and to permit height adjustment of the swing seat 111, the swing 100 is further provided with a support bar 144. The seat 111 is mounted to the support bar 144 as explained below. As most easily seen in FIGS. 7 and 8, the support bar 144 is preferably U-shaped. The upper ends of the U-shaped support bar 144 are coupled to respective ones of the lower ends of the support arms 138 such that the support arms 138 and support bar 144 telescope to move the seat 111 between a raised height position (see FIG. 7) and a lowered height position (see FIG. 8). More specifically, as shown in FIG. 12, like the support arm 138, the support bar 144 is tubular. Each of the support arms 138 has an outer diameter that is smaller than the inner diameter of the support bar 144 (at least at the upper end of the support bar 144) such that the support arms 138 can slide within the upper ends of the support bar 144 In other words, the support bar 144 can be moved along the longitudinal axes of the support arms 138 to telescope with the support arms 138 to adjust the height of the seat 111.

To define the lowered height position of the seat 111 as well as to ensure the support arms 138 do not rattle within the support bar 144, the ends of the support arms 138 are each rolled outward to form an annular ledge 150. As shown in FIG. 12, the annular ledge 150 has an outer diameter that is only slightly smaller than the inner diameter of the support bar 144 to permit sliding movement therebetween while keeping the longitudinal axes of the upper ends of the U-shaped support bar 144 in substantial alignment with respective ones of the longitudinal axes of the support arms 138. Preferably, the outer surface of the annular ledge 150 is smooth to reduce friction with the support bar 144.

Figure 12A:
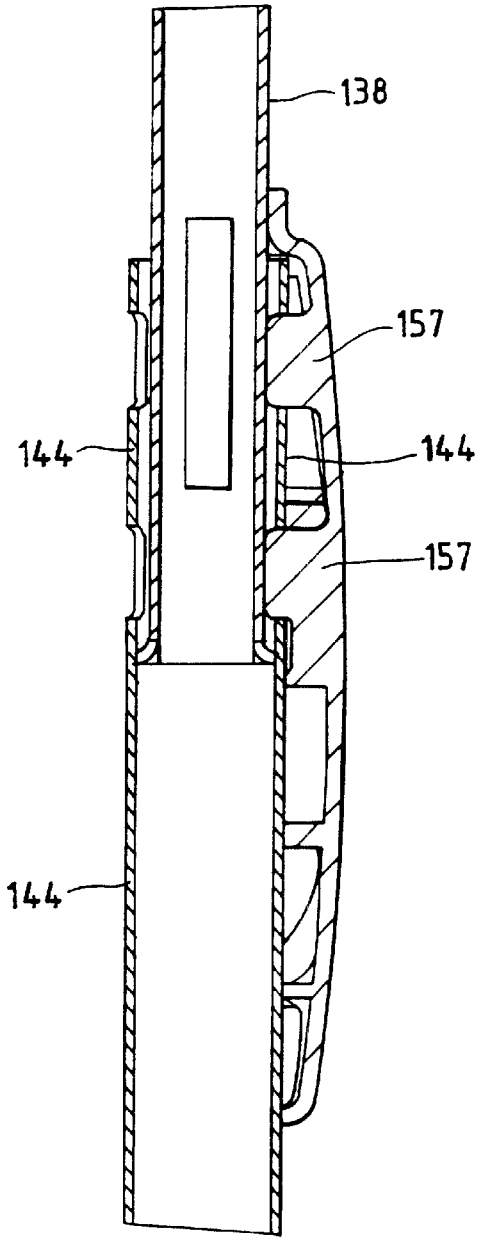
FIG. 12A is a partial cross-sectional view of the housing of the clamp assembly and the telescoping seat support.
Figure 12B:
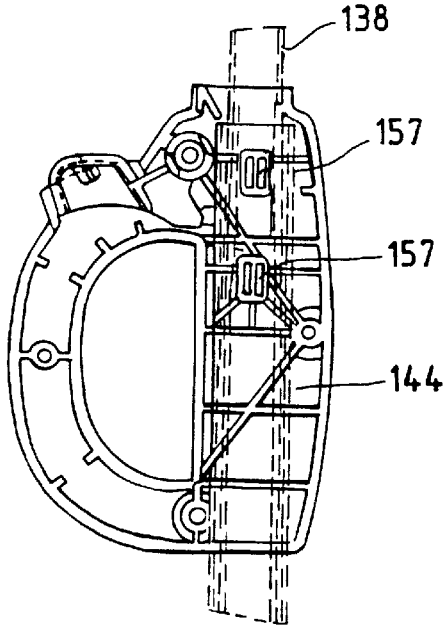
FIG. 12B is a view similar to FIG. 12A, but showing the housing and seat support rotated by 90°.

Each of the upper ends of the U-shaped support bar 144 defines an aperture for slidingly receiving one of the support arms 138. As shown in FIGS. 12A and 12B, a multitude of protrusions 157 extend through openings in the support bar 144 as part of the ring-shaped housings 178 forming the clamp assembly 162. The protrusions 157 cooperate with the annular ledge 150 to define the lower height position of the seat 111. In other words, the annular ledge 150 and lowermost protrusions 157 contact one another to provide one limit on the relative telescoping movement between the support arms 138 and the support bar 144. Unless the seat 111 is secured in a raised position, gravity will ensure the support bar 144 moves downward relative to the support arm 138 until the ledge 150 and lowermost protrusions 157 engage to suspend the seat 111 in the lowered position (e.g., the position shown in FIG. 8).

For the purpose of releasably securing the support bar 144, and, thus, the seat 111, in the raised position (e.g., the position shown in FIG. 7), the swing 100 is further provided with two clamp assemblies 162, one associated with each support arm. Because the clamp assemblies 162 are identical, the following description focuses on one of the assemblies 162 with the understanding that the description of the other assembly is the same. As most easily seen in FIG. 12, the clamp assembly 162 includes a bore 164 defined in the upper ends of the U-shaped support bar 144. It also includes a spring button 166 mounted within the support arm 138. As shown in FIG. 12, the spring button 176 includes a U-shaped spring portion 168 and a button or lug 170. The button or lug 170 projects outward from the U-shaped spring portion 168 and is dimensioned to simultaneously mate with a bore 172 defined in the support arm 138 and the bore 164 in the support bar 144. When the lug 170 is positioned in both bores 164, 172, it precludes relative longitudinal movement between the support arms 138 and the support bar 144 to thereby removably secure the seat 111 in the raised position (e.g., the position shown in FIG. 7).

To selectively displace the spring button 166 from the bore 164 of the support bar 144 to thereby release the support bar 144 and seat from the raised position, the clamp assembly 162 is provided with an actuator 176. As shown in FIG. 12, the clamp assembly 162 includes a ring shaped housing 178. The actuator 176, which is pivotably mounted to the housing 178 via a pin 180, includes a projection 182 which is located for selectively engaging the lug 170 of the spring button 166. The actuator 176 also includes an actuating surface 184 which can be engaged from outside the housing 138. When the actuating surface 184 is depressed, the actuator 176 pivots (clockwise in FIG. 12) such that the projection 182 displaces the lug 170 against the spring force of the spring button 166 and out of the bore 164. When the lug 170 is so displaced, the support bar 144 and the seat 111 are released for movement relative to the support arm (i.e., the seat 111 can be lowered).

To improve the feel of the actuator 176, a spring 188 is positioned within the housing 178 between a spring seat 190 formed on an inner surface of the housing 178 and a spring seat 192 formed on the actuator 176. This spring 1 88 bias the actuator 176 outward relative to the housing 178 to the position shown in FIG. 12. To displace the lug 170 from the bore 164, the actuator 176 must, therefore, be depressed with sufficient force to overcome the spring force of the spring button 166 and the spring force of the spring 188.

Persons of ordinary skill in the art will readily appreciate that, although the spring 188 is preferably included to improve the user's perception of the clamp assembly 178, its inclusion is purely cosmetic and the spring 188 can, therefore, be eliminated without departing from the scope or spirit of the invention.

Since, when the lug 170 is displaced from the bore 164, gravity will attempt to pull the support bar 144 and seat 111 downward, the housing 178 of the clamp assembly 162 is preferably shaped as a gripping ring which can easily be grasped by the hand of an adult user located in front of the swing 100 to control movement of the seat 111 upon release of the clamp. Moreover, as shown in FIG. 12, the actuator 176 is preferably positioned near the top of the housing 178 such that a user can actuate the actuator 176 with a thumb of a hand simultaneously gripping the housing 178. As a result, the clamping assembly 160 can be actuated to release the seat 111 for movement to the lowered position while the user supports the seat 111 and support bar 144 against gravity with the hand gripping the housing 178.

Persons of ordinary skill in the art will readily appreciate that, while the illustrated swing 100 employs two clamp assemblies 160 (and, thus, requires two hands to move the seat 111 from the raised to the lowered position), one of the clamp assemblies 160 could be eliminated in whole or in part (e.g., housing present with no clamping function) without departing from the scope or spirit of the invention. Moreover, although the illustrated clamp assembly 160 only secures the seat 111 at the raised position (i.e., the ledge 150, protrusions 157 and gravity hold the seat 111 in the lowered position without the assistance of the clamp assembly 160), persons of ordinary skill in the art will readily appreciate that the clamp assembly 160 can be modified to positively secure the seat 111 in the lowered position (e.g., by adding another button spring and bores) without departing from the scope or spirit of the invention. The illustrated approach wherein the seat 111 and support bar 144 can be moved from the lowered position to the raised position without releasing the clamp assembly 160 is, however, preferred because it reduces part counts and costs, and increases the ease of operating the swing 100.

Figure 9:
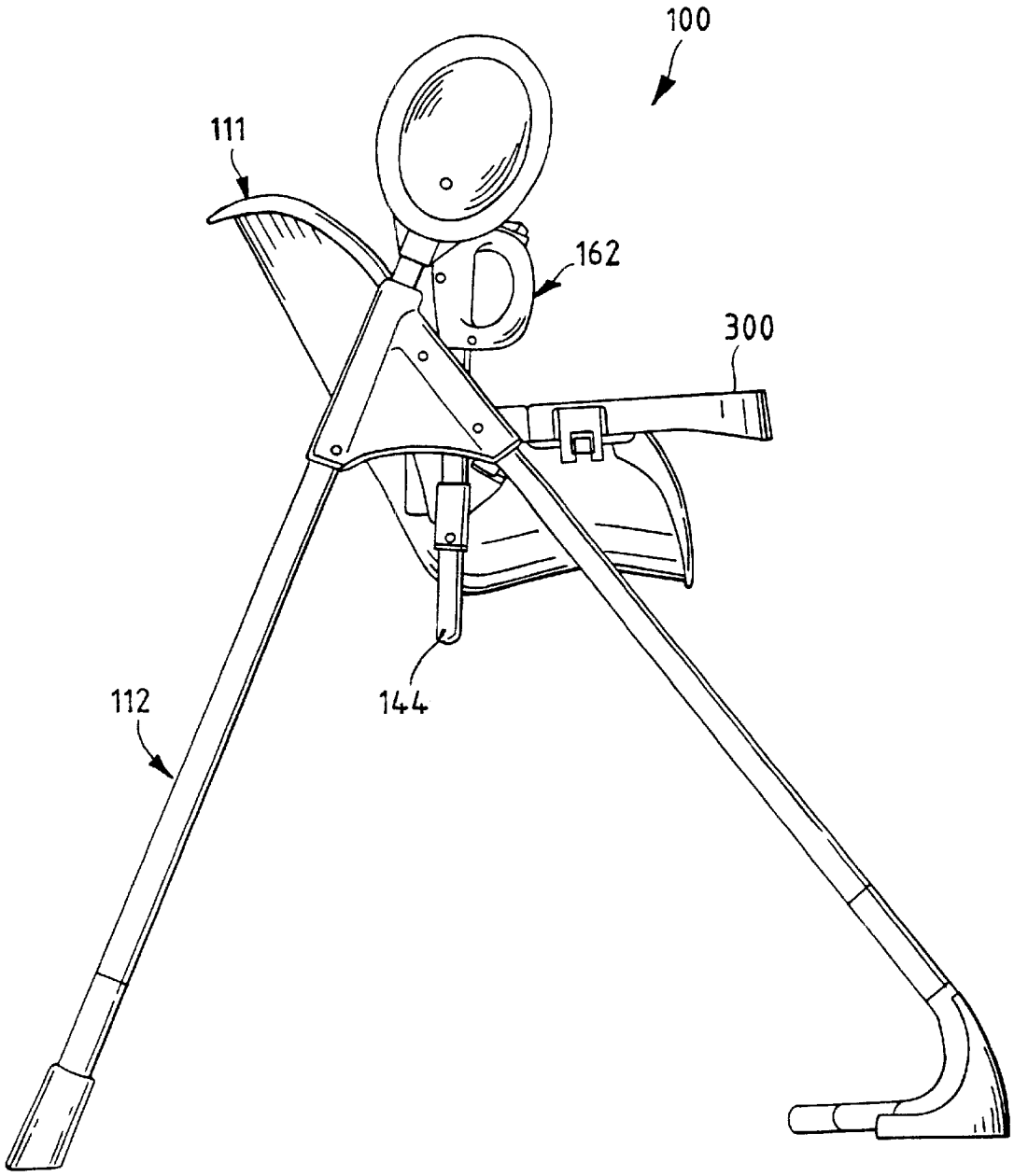
FIG. 9 is a left side view of the swing showing the seat in a raised, upright position.
Figure 10:
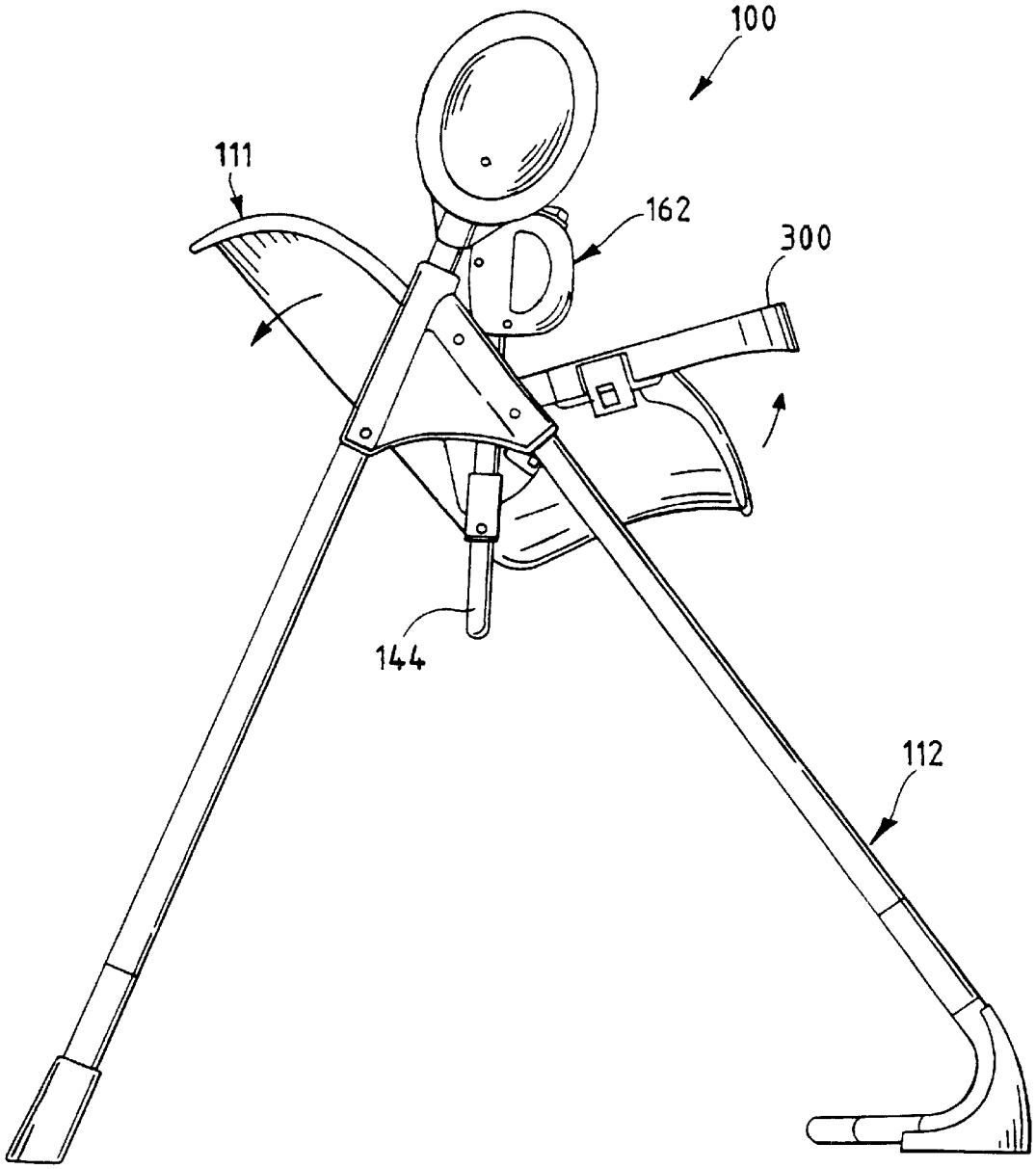
FIG. 10 is a view similar to FIG. 9, but showing the seat in a raised, tilted position.

As mentioned above, the seat 111 is coupled to the support bar 144 such that, adjusting the height of the support bar 144 adjusts the height of the seat 111. As shown in FIGS. 9 and 10, the seat 111 is also coupled to the support bar 144 such that the scat can be tilted between an upright position such as the position shown in FIG. 9 and a reclined position such as the position shown in FIG. 10. To this end, the swing 100 is provided with a tilt clamp 190 on one side of the seat 111.

Figure 13:
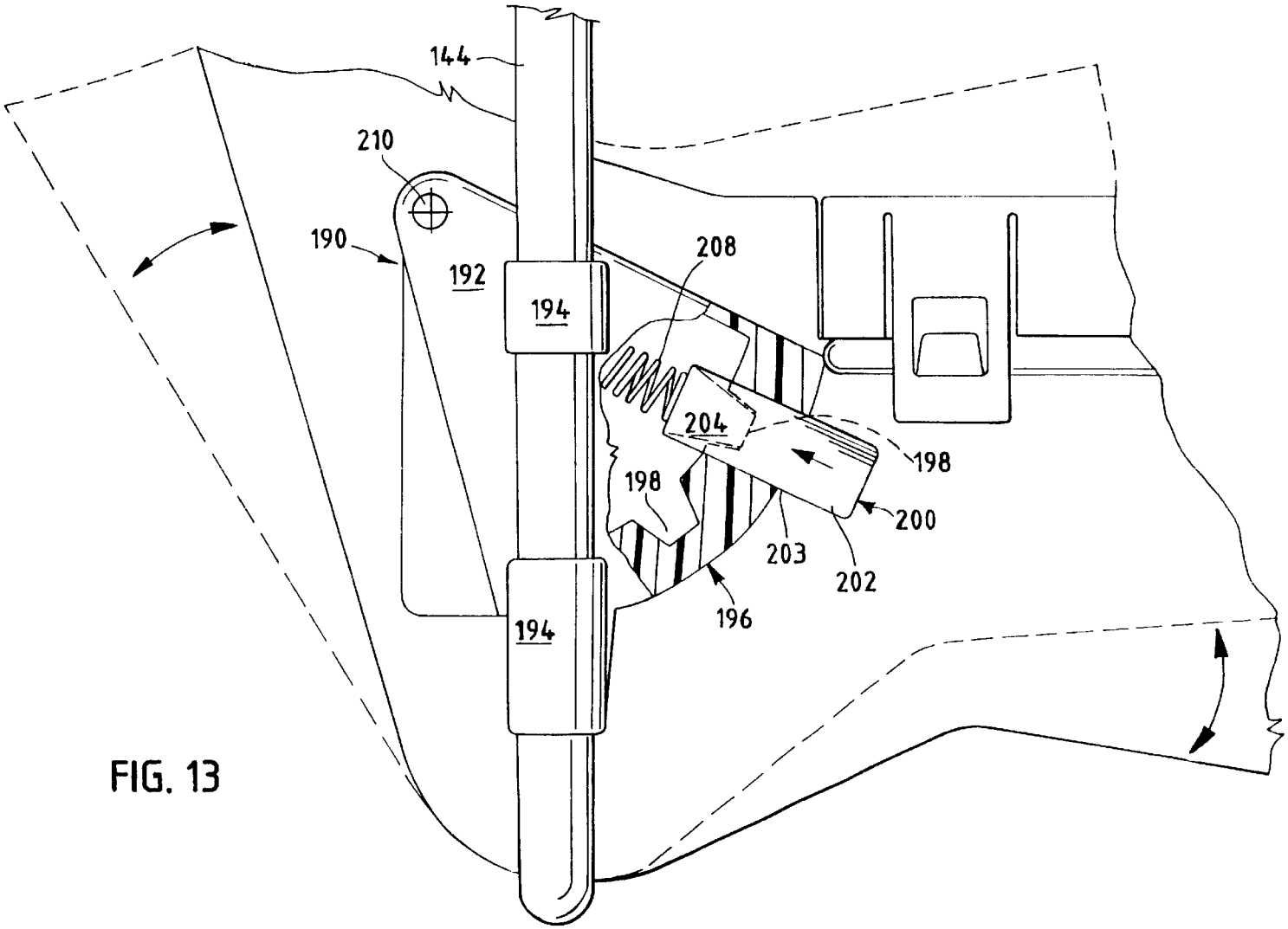
FIG. 13 is an enlarged, cross-sectional view of the seat recline adjustment mechanism of the swing of FIG. 1.

As most easily seen in FIG. 13, the tilt clamp 190 includes a housing 192. The housing 192 includes two tubular cars or clamps 194 which project outward from the housing 192. The tubular ears 194 are disposed in substantial alignment and have inner diameters which are dimensioned to receive one of the upper ends of the U-shaped support bar 144. Conventional fastener such as rivets secure the ears 194 to the support bar 144.

To cooperate with the tilt clamp 190, the side of the seat 111 includes an arcuate rail 196 defining at least two apertures or bores 198. The arcuate rail 196 is fixed to the seat 111.

Figure 13B:
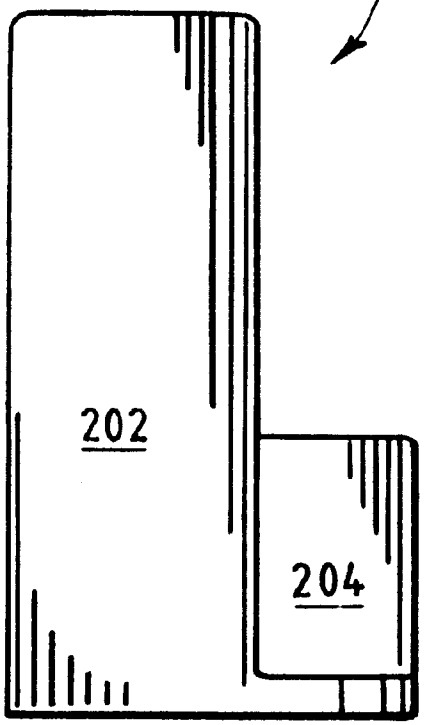
FIG. 13B is a front view of the actuator shown in FIG. 13A.
Figure 13A:
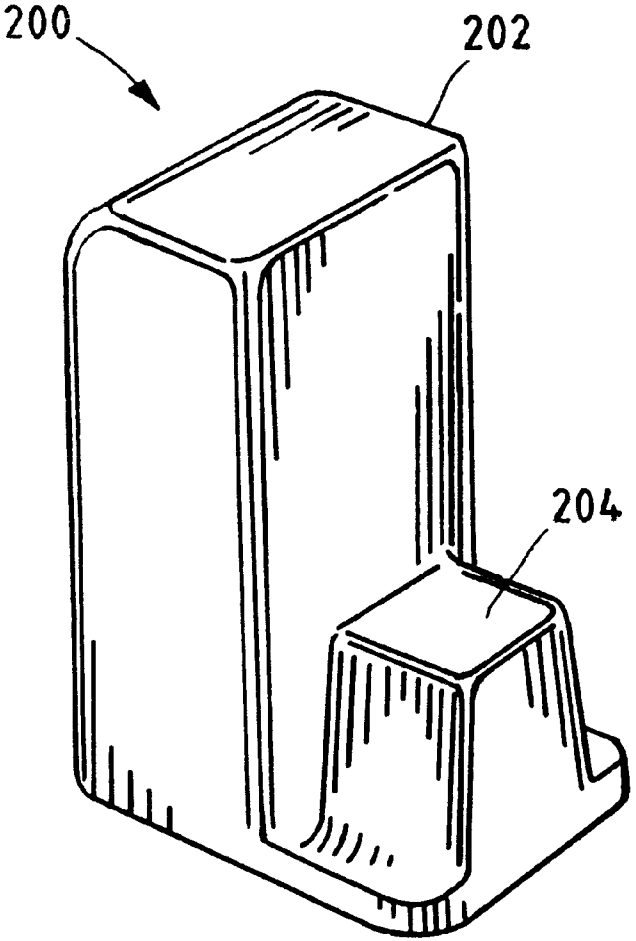
FIG. 13A is an enlarged perspective view of an actuator of a tilt clamp of the swing of FIG. 1.

The tilt clamp 190 carries a clamp button 200. As shown in FIGS. 13A and 13B, the clamp button 200 includes an actuator 202 and a lug 204. The actuator 202 is dimensioned to extend through a bore 203 defined in the housing 192 such that a portion thereof can be engaged by a user. The lug 204 is integrally formed with the actuator 202 and remains within the housing 192 during use. As shown in FIGS. 13A and 13B, the actuator 202 and lug 204 are disposed in side-by-side relation with their longitudinal axes being substantially parallel.

A clamp spring 208 is disposed within the tilt clamp 190. As shown in FIG. 13, one end of the clamp spring 208 is located in a pocket (not shown) formed in an inner surface of the housing 192. The opposite end of the clamp spring 208 is seated within the lug 204. The pocket is positioned and the spring 208 is selected such that the spring 208 biases the clamp button 200 outward relative to the housing 192 into the position shown in FIG. 13. The lug 204 is dimensioned to selectively mate with the bores 198 defined in the rail 196 of the seat 111.

The clamp housing 192 is pivotably coupled to the seat 111 via a conventional fastener 210 such as a rivet. A pivot housing 193 (see FIG. 5) is located on the side of the seat 111 opposite the clamp housing 192. The pivot housing 193 is similar to the clamp housing 192 in appearance. Like the clamp housing 192, the pivot housing 193 includes tubular ears (like ears 194) which fasten the pivot housing 193 to one of the upper ends of the U-shaped support bar 144 via conventional fasteners. Also like the clamp housing 192, the pivot housing 193 is pivotably coupled to the seat 111 via a conventional fastener such as a rivet. Unlike the clamp housing 192, the pivot housing 193 is not associated with a tilt clamp 190 to reduce parts counts and enable one hand operation to the tilt function to the seat.

Since, the clamp housing 192 and the pivot housing 193 are secured to the support bar 144, the seat 111 can be tilted relative to the support bar 144 and housing 192 by rotating the scat 111 about the fasteners 210. Because the engagement of the lug 204 and rail bore 198 prevents such tilting, when it is desired to move the seat between the reclined and upright positions, the user must depress the actuator 202 against the force of the spring 208 to displace the lug 204 from the bore 198. When the lug 204 is so displaced, the seat 111 can be tilted to a position wherein the lug 204 aligns with a different bore 198. When such alignment is achieved and the actuator 202 is released, the spring 208 will force the clamp button 200 outward such that the lug 204 enters the new bore to secure the seat in its new tilt position (e.g., the reclined or upright. position).

Figure 7:
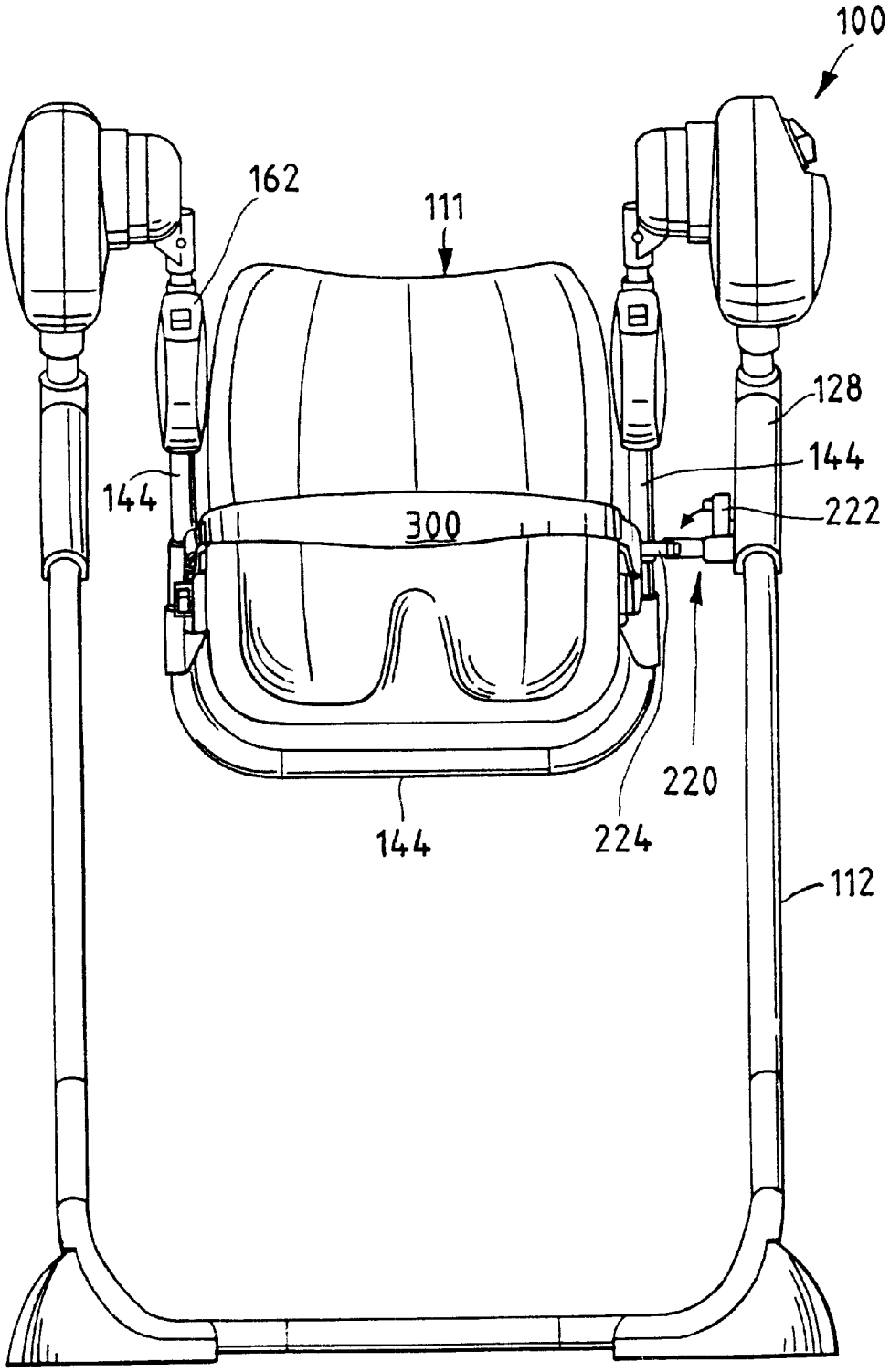
FIG. 7 is a font view of the swing of FIGS. 1 and 2 with the seat in the raised position.

Persons of ordinary skill in the art will readily appreciate that, in order to permit tilting of the seat 111, the tilt clamp 190 must be secured to the support bar 144 at a location that provides sufficient clearance between the bottom of the seat 111 and the top of the support bar 144 (see FIG. 7). Persons of ordinary skill in the art will also appreciate that, although the illustrated swing 100 is tiltable between only two positions, the swing 100 can be adapted for tilting between more than two positions without departing from the scope or spirit of the invention.

Figure 17:
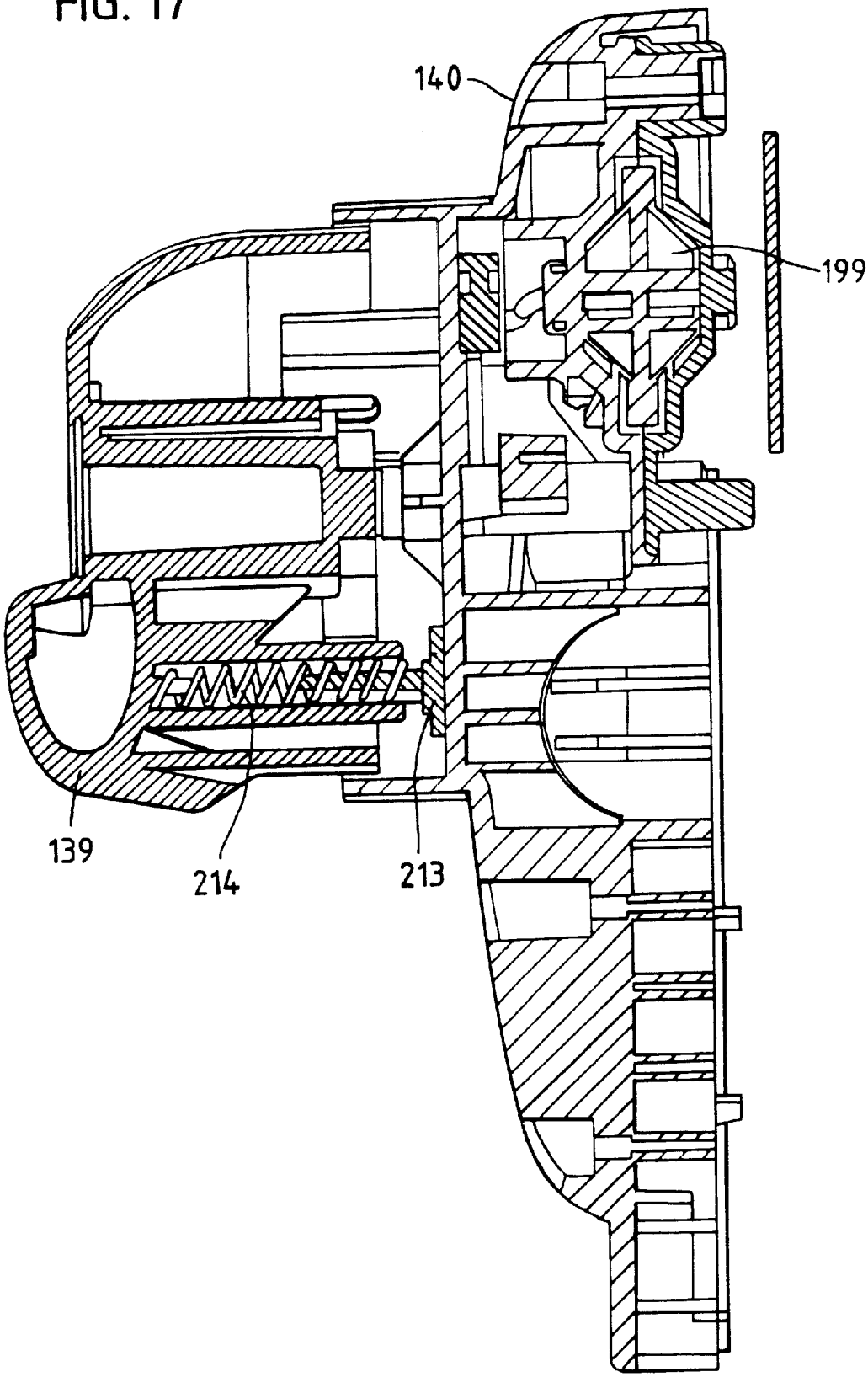
FIG. 17 is a cross-sectional view of a motor housing.

As with the swing 10 described above, the swing 100 is provided with a motor 199 (FIG. 17). The motor 199 is preferably located in one of the motor housings 140 and operates to drive one of the support arms 138 through an arcuate motion path. Because the support bar 144, seat 111 and support arms 138 are rigidly connected, driving one support arm causes all of these components to swing through the arcuate path. Preferably, the motor is an electric motor powered by batteries, but other power sources including, by way of example, commercial electrical power could be used without departing from the scope or spirit of the invention.

Any conventional coupling mechanism can be employed to couple the motion of the motor to the support arm 138. The precise coupling mechanism used forms no part of the invention and is not discussed in detail herein. However, one portion of the coupling mechanism merits further discussion.

Figure 18:
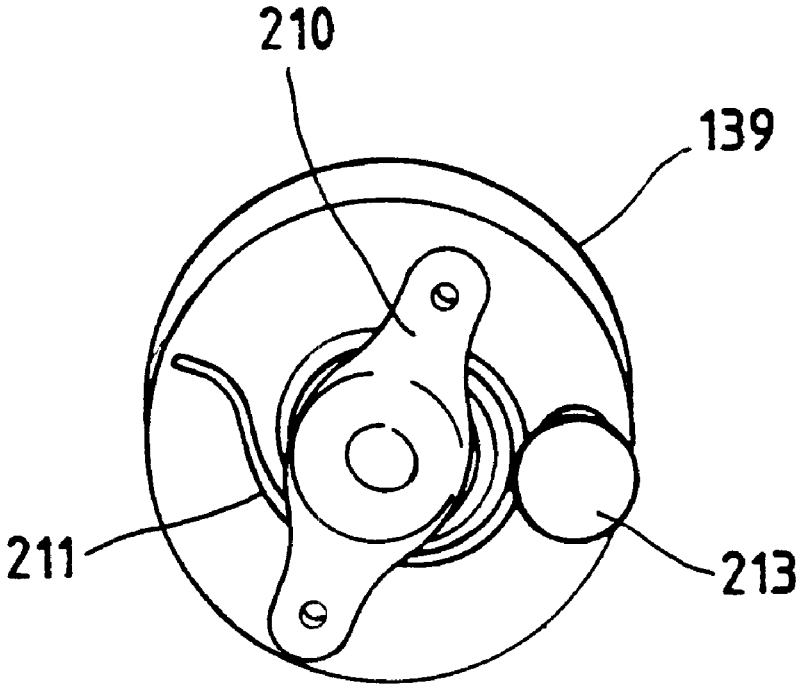
FIG. 18 is a perspective view of a coupling mechanism for coupling the motor to the seat support.

As shown in FIG. 18, one of the swing pivots 139 carries a rocker 210 mounted on a torsion spring 211. The rocker 210 and torsion spring 211 are coupled to the motor and form part of the conventional coupling mechanism mentioned above. When the motor applies power to move the rocker 210, the rocker 210 and spring 211 will oscillate back and forth to, in turn, swing the support arms 138 through the arcuate motion path. The motor is preferably controlled to add power to the pendulum formed by the support arms 138 and seat 111 such that the seat 111 swings through a substantially constant distance (unless another travel distance is selected by a user as explained below).

Since the swing 100 is preferably intended for use with small children, a gentle swinging motion of the seat 111 is desired. As will be appreciated by persons of ordinary skill in the art, the desire for the best battery life implies that the coupling mechanism delivering energy from the motor to the seat 111 should be as low-friction as possible. However, the output of the motor and the frictional resistance experienced by the seat 111 must be balanced to ensure the seat swings in a stable arcuate path. If these factors are not balanced, the system can become unstable such that the seat 111 swings through a greater arc than is desired.

In order to keep the motor and seat pendulum operating in synchronization so that the seat swings in a stable range, the coupling mechanism is provided with a friction inserter that adds a controlled amount of friction to the coupling mechanism. In the illustrated swing 100, the friction inserter is implemented by a button 213 and a spring 214. As shown in FIG. 17, the button 213 is a plastic member with an upper surface designed to frictionally engage an inner wall of the motor housing. The spring 214 is mounted in a spring seat formed in the swing pivot 139 and a second spring seat formed in the button 213. The spring 214 forces the button 213 into frictional engagement with the motor housing. The amount of friction developed by this engagement can be selected by picking the size (i.e., the spring force) of the spring 214. In the illustrated friction inserter, the friction inserter increases the power demand of the swing by 30%–50%.

As mentioned above, the relative position of the seating surface of the seat 111 and the pivot points of the support arms 138 can be adjusted in the illustrated swing 100. This capability has many significant uses. For example, a child care provider might wish to utilize the swing for feeding a child. To this end, it might be preferable to position the child at a relatively high level by raising the scat 111 to the raised position where the swing 100 can function as a highchair. By way of another example it is easier for a standing adult to remove/insert a child from/into the swing if the seat 111 is positioned at a relatively high position. The illustrated swing 100 addresses this issue by permitting movement of the seat 111 to the raised position to remove or insert the child.

Figure 14:
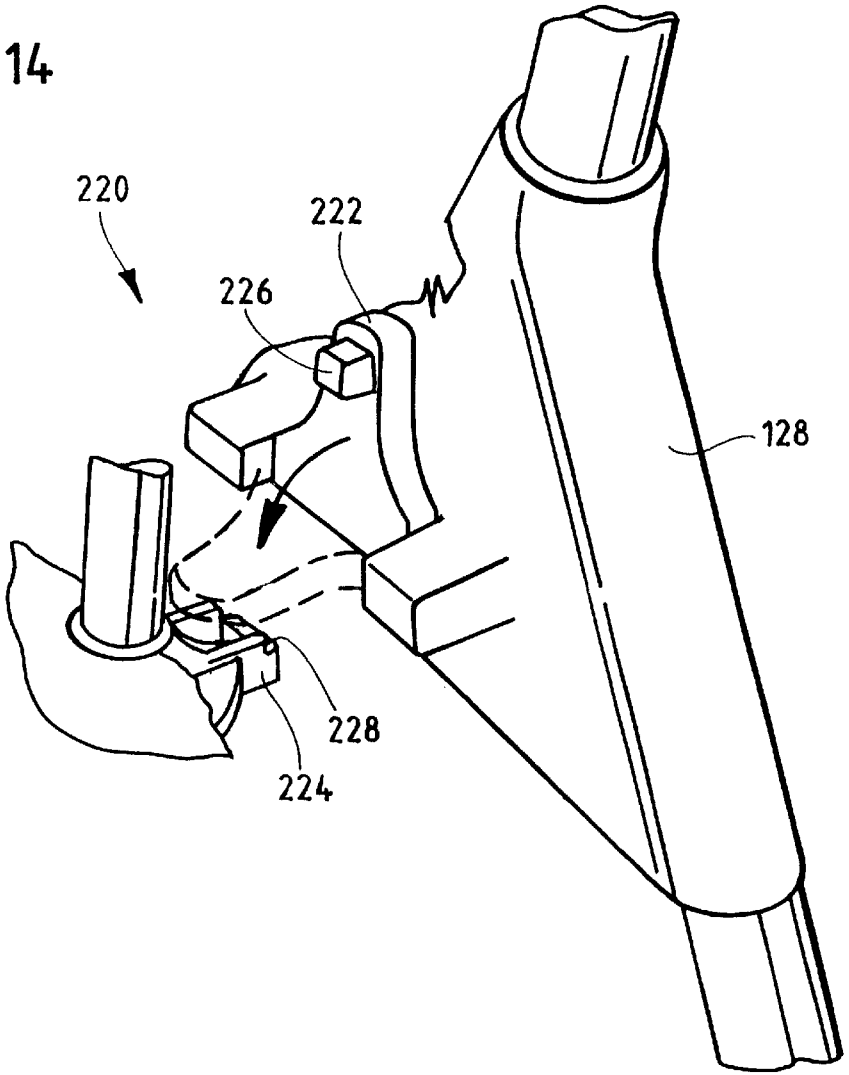
FIG. 14 is an enlarged view of the seat lock mechanism of the swing of FIG. 5.

To further facilitate removal/insertion of a child from/into the swing 100, and to further facilitate use of the swing 100 as a highchair for feeding, the swing 100 is further provided with a seat latch 220 for selectively securing the seat 111 against swinging movement. As shown in FIG. 14, the swing latch 220 includes a pivotable arm 222 mounted adjacent one of the frame housings 128. The latch 220 also includes a receiver 224 which is mounted to the support bar 144. The arm 222 includes a lug 226 and the receiver 224 defines a bore 228 sized to receive the lug 226. When the arm 222 is pivoted downward such that the lug 226 enters the bore 228, the seat 111 is held against swinging movement. Because it is advantageous to secure the seat 111 against swinging movement when inserting/removing a child from the swing 100 and/or when using the swing 100 as a highchair, the seat latch 220 is operational when the seat 111 is in the raised position (see FIG. 7). When the seat is in the lowered position (see FIG. 8), the receiver 224 is displaced from the arm 222 and the latch 220 is not operational. (Although the receiver 224 is shown as a separate part in the drawings, in the preferred embodiment the receiver 224 is actually integrally formed with the pivot housing 193.)

Adjusting the height of the seat 111 will adjust the instantaneous speed at which the seat swings and the distance it travels (even if the power output by the motor remains unchanged). However, enhanced control over the distance the seat 111 swings is achieved in the illustrated swing 110 by providing a control circuit 250 which is coupled to the motor 252 to select the power output by the motor. In particular, as explained below, the control circuit 250 is preferably adapted to permit the user to select the power output by the motor 252 within one range when the seat 111 is in the raised position and to select the power output of the motor 252 within a different range when the seat 111 is in the lowered position. These ranges may or may not partially overlap.

Figure 15:
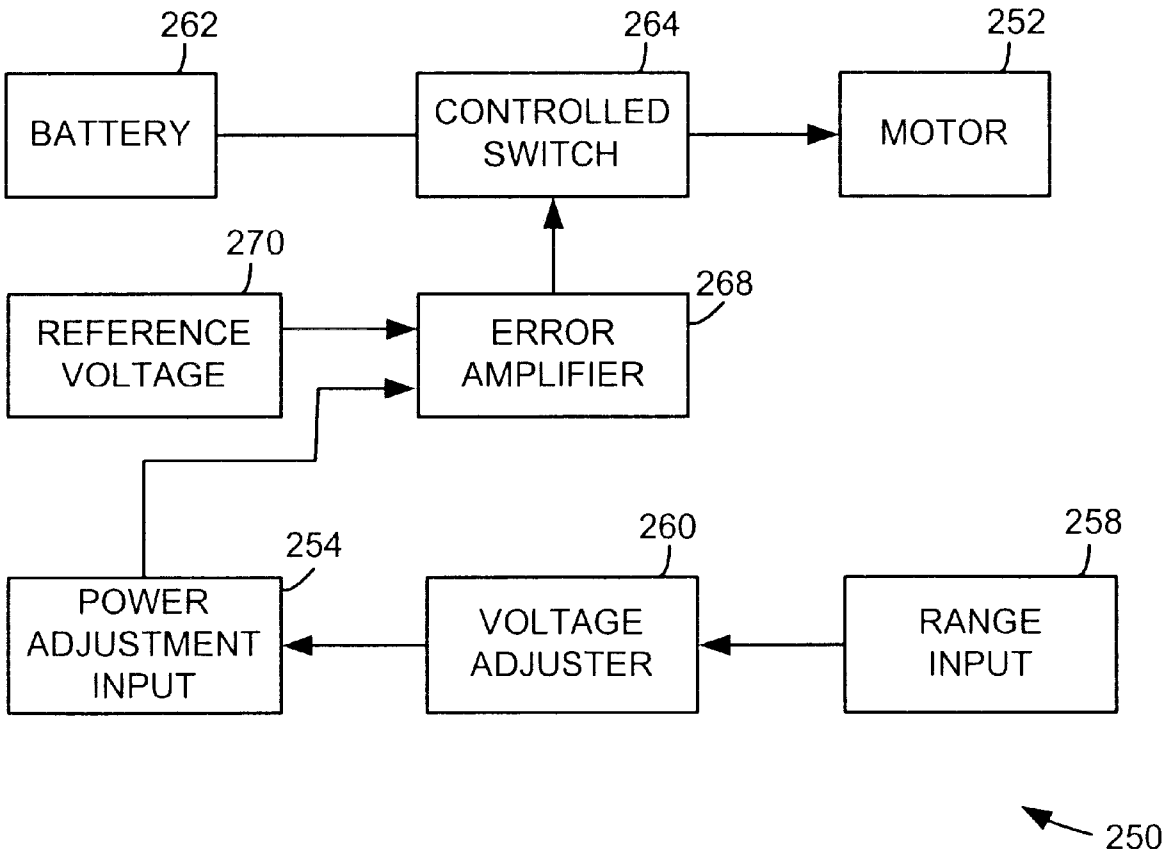
FIG. 15 is a block diagram illustrating a speed control circuit for use in the swing of FIG. 5.

A block diagram illustrating a preferred implementation of the control circuit 250 is shown in FIG. 15. For the purpose of selecting the power output by the motor 252, the control circuit 250 is provided with a power adjustment input 254. The control circuit 250 is also provided with a range input 258 and a voltage adjuster 260. The voltage adjuster 260 is responsive to user manipulation of the range input 258 to define the range of power outputs which are selectable by the power adjustment input 254. Preferably, the voltage adjuster 260 is structured to permit the user to select between two different ranges. However, persons of ordinary skill in the art will readily appreciate that the voltage adjuster 260 can alternatively be configured to adapt the power adjustment input 254 to more than two ranges without departing from the scope or spirit of the invention. Nonetheless, as mentioned above, in the illustrated swing 100, only two ranges are provided. One range is dimensioned for use when the seat is in the raised position and the other range is dimensioned for use when the seat is in the lowered position.

As mentioned above, the motor 252 is preferably an electric motor supplied with voltage from a battery 262. As shown in FIG. 15, the control circuit 250 includes a controlled switch 264 for controlling the amount of voltage delivered from the battery 262 to the motor 252.

For the purpose of adjusting the conducting state of the controlled switch 264, the control circuit 250 is further provided with an error amplifier 268. As shown in FIG. 15, the error amplifier 268 compares the output voltage of the power adjustment input 254 to a reference voltage 270. The difference signal developed by the error amplifier 268 adjusts the conducting state of the switch 264 to thereby control the voltage delivered to (and, thus, the power output by) the motor 252.

Figure 16:
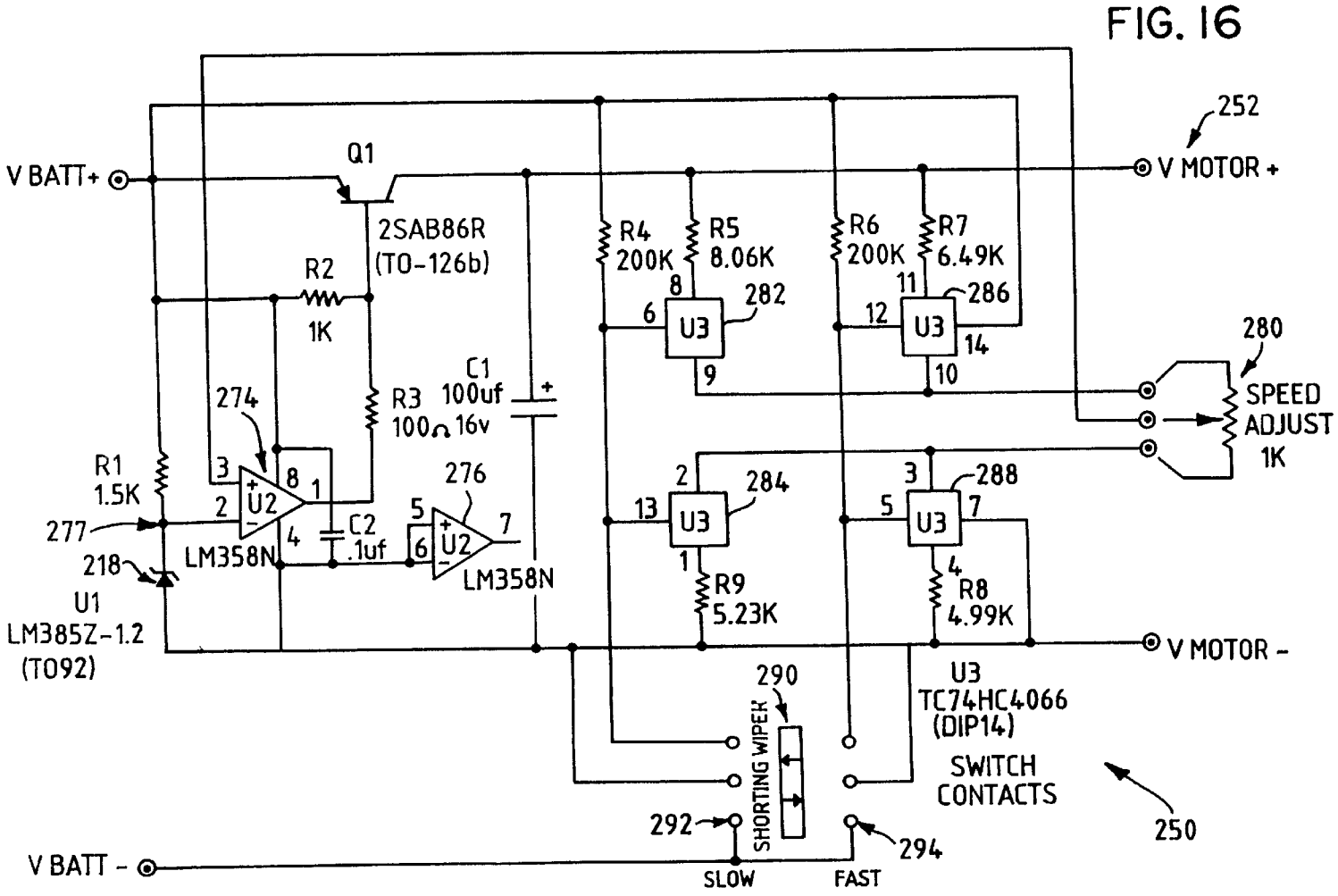
FIG. 16 is a more detailed schematic illustration of the circuit of FIG. 15.

A more detailed schematic illustration of the control circuit 250 is shown in FIG. 16. As shown in that figure, the controlled switch 264 is implemented by a transistor Q1. The base of the transistor Q1, is coupled to the output of an operational amplifier 274 (op-amp) through a resistor R3. The op-amp 274 together with certain biasing circuitry (i.e., resistor R2, capacitor C2 and op amp 276) implement the error amplifier 268.

One input of the op-amp 274 is coupled to a node 277 between resistor R1 and breakdown diode 278. Resistor R1 is connected to the positive terminal of the battery 262 and cooperates with the diode 278 to set the reference voltage 270 at the second input of the op-amp 274.

The second input of the op-amp 274 is coupled to a rheostat 280 implementing the power adjustment input 254. The voltage across the rheostat 280 can be adjusted. To this end, the control circuit 252 is provided with two pairs of multiplexors 282, 284, 286, 288, biasing resistors R4, R5, R6, R7, R8, R9, and a shorting wiper 290. The multiplexors 282, 284, 286, 288 and the biasing resistors R4, R5, R6, R7, R8, R9 implement the voltage adjuster 260, and the shorting wiper 290 implements the range input 258.

As shown in FIG. 16, the shorting wiper is movable between two sets of contacts, namely slow contacts 292 and fast contacts 294. When the wiper 290 engages the slow contacts 292, the first pair of multiplexors 282, 284 is energized and the second pair of multiplexors 286, 288 is off such that resistors R5 and R9 are placed in series with the rheostat 280. When the shorting wiper 290 engages the fast contacts 294, the first pair of multiplexors 282, 284 is turned off and the second pair of multiplexors 286, 288 is energized such that resistors R7 and R8 are placed in series with the rheostat 280. Because the values of R5 and R9 are different from the values of R7 and R8, a different voltage will appear across the rheostat 280 when the shorting wiper 290 engages the slow contacts 292 then when the shorting wiper 290 engages the fast contacts 292. When the shorting wiper engages neither the slow contacts 292 nor the fast contacts 294, no current is drawn from the battery 262 and the voltage control circuit 250 and the motor 250 are off.

Persons of ordinary skill in the art will recognize from FIG. 16 that the illustrated control circuit 250 is a series pass regulator. The rheostat 280 is in a feedback loop with the op-amp 274 which functions to change the state of the transistor Q1 until the difference signal developed by the op-amp 274 is zero. Every time the rheostat 280 is adjusted, the position of the shorting wiper 290 is changed, or the load on the motor 252 is changed, the feedback loop will control the state of the transistor Q1 to adjust the voltage delivered to the motor 252 until the difference signal output by the op-amp 274 is zero.

In order to support food, toys and/or other items in front of a child seated in the seat 111, the swing 100 if further provided with a conventional tray 300.

Although the swing 100 raises and lowers the seat 111 relative to the ground and pivot points to achieve height adjustability, persons of ordinary skill in the art will readily appreciate that a similar result can be achieved by making the height of the pivot points of the swing relative to the ground adjustable while the height of the seat 111 relative to the ground remains constant without departing from the scope or spirit of the invention.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A swing for an infant or child comprising:

a frame;

a first support arm suspended for swinging movement relative to the frame;

a seat;

a support bar coupled to the seat, the support bar having a first end, the first end of the support bar telescoping with the first support arm such that the seat can be moved between a first height for swinging the seat in a first arcuate path and a second height for swinging the seat in a second arcuate path; and means cooperating with the support arm for selectively securing the seat at the first height for swinging the seat in the first arcuate path and for selectively securing the seat at the second height for swinging the seat in the second arcuate path.

2. A swing as defined in claim 1 further comprising:

a second support arm suspended for swinging movement relative to the frame, the support bar having a second end telescoping with the second support arm.

3. A swing as defined in claim 2 wherein the support bar is U-shaped.

4. A swing as defined in claim 1 wherein the first height is greater than the second height and further comprising a clamp assembly for releasably securing the seat at the first height.

5. A swing as defined in claim 4 further comprising a first ledge associated with the first support arm and a second ledge associated with the support bar, wherein the first and second ledges cooperate to define the second height of the seat.

6. A swing as defined in claim 5 wherein the seat can be moved from the second height to the first height without releasing the clamp assembly.

7. A swing as defined in claim 4 wherein the clamp assembly comprises:

a bore defined in one of the first support arm and the support bar;

a spring button carried by a second one of the first support arm and the support bar, the spring button being dimensioned to mate with the bore to removably secure the seat at the first height; and an actuator positioned to selectively displace the spring button from the bore to release the seat for movement out of the first height.

8. A swing as defined in claim 7 wherein the clamp assembly further comprises a ring shaped housing, and the actuator is coupled to the housing.

9. A swing as defined in claim 1 further comprising a seat latch for selectively substantially securing the seat against swinging movement.

10. A swing as defined in claim 9 wherein the swing latch is operational when the seat is at the first height.

11. A swing as defined in claim 1 wherein the seat can be tilted between an upright position and a reclined position.

12. A swing as defined in claim 1 wherein the frame is foldable.

13. A swing as defined in claim 1 further comprising a motor operatively coupled to the first support arm for swinging the first support arm and the seat.

14. A swing for an infant or child comprising:

a frame;

a first support arm suspended for swinging movement relative to the frame;

a seat;

a support bar coupled to the seat, the support bar having a first end, the first end of the support bar telescoping with the first support arm such that the seat can be moved between a first height for swinging the seat in a first arcuate path and a second height for swinging the seat in a second arcuate path;

a motor operatively coupled to the first support arm for swinging the first support arm and the seat; and a control circuit coupled to the motor for controlling the power output by the motor, the control circuit including a power adjustment input for selecting the power output by the motor, and further including a range input for selecting a range of power outputs selectable by the power adjustment input.

15. A swing as defined in claim 14 wherein the range input permits selection between a first power output range and a second power output range.

16. A swing as defined in claim 15 wherein the first power output range is dimensioned for use when the seat is at the first height and the second power output range is dimensioned for use when the seat is at the second height.

17. A swing for an infant or child comprising:

a frame;

a first support arm suspended for swinging movement relative to the frame;

a seat;

a support bar coupled to the seat, the support bar having a first end, the first end of the support bar telescoping with the first support arm such that the seat can be moved between a first height for swinging the seat in a first arcuate path and a second height for swinging the seat in a second arcuate path;

a motor operatively coupled to the first support arm for swinging the first support arm and the seat; and a control circuit coupled to the motor, the control circuit permitting selection of the power output by the motor within a first range when the seat is at the first height and permitting selection of the power output by the motor within a second range when the seat is at the second height.

18. A swing for an infant or child comprising:

a frame;

a first support arm suspended for swinging movement relative to the frame, the first support arm having a first longitudinal axis;

a seat;

a support bar coupled to the seat, the support bar slidably engaging the first support arm such that the support bar is movable relative to the first longitudinal axis, wherein moving the support bar relative to the first longitudinal axis adjusts a height of the seat to enable selective swinging of the seat in at least two different arcuate paths;

means for selectively securing the support bar to the first support arm such that the seat is positioned for swinging movement in a first one of the at least two different arcuate paths; and means for selectively securing the support bar to the first support arm such that the seat is positioned for swinging movement in a second one of the at least two different arcuate paths.

19. A swing as defined in claim 18 further comprising:

a second support arm suspended for swinging movement relative to the frame, the second support arm having a second longitudinal axis, and the support bar slidably engaging the second support arm such that the support bar is simultaneously movable relative to the first and second longitudinal axes to adjust the height of the seat.

20. A swing for an infant or child comprising:

a frame;

at least one support member suspended for swinging movement relative to the frame;

a seat and a tilt clamp coupling the seat to the at least one support member such that the seat can be tilted between an upright position and a reclined position, the seat also being movable between a first height and a second height; and a clamp assembly cooperating with the at least one support member for selectively securing the seat in at least one of the first and second heights.

21. A swing for an infant or child comprising:

a frame;

a first support arm suspended for swinging movement relative to the frame;

a seat suspended by the first support arm;

a motor operatively coupled to the first support arm for swinging the first support arm and the seat, the motor having a power output; and a control circuit coupled to the motor, the control circuit including a power adjustment input for selecting the power output of the motor, and further including a range input for selecting a range of power outputs selectable by the power adjustment input.

22. A swing for an infant or child comprising:

a frame;

a first support arm suspended for swinging movement relative to the frame;

a seat suspended by the first support arm, the seat being movable between a first height and a second height;

a motor operatively coupled to the first support arm for swinging the first support arm and the seat, the motor having a power output; and a control circuit coupled to the motor, the control circuit permitting selection of the power output of the motor within a first range when the seat is at the first height and permitting selection of the power output of the motor within a second range when the seat is at the second height.

23. A swing for an infant or child comprising:

a frame;

a first support arm suspended for swinging movement relative to the frame;

a second support arm suspended for swinging movement relative to the frame;

a seat suspended by the first and second support arms;

a motor operatively coupled to the first support arm for swinging the first support arm and the seat, the motor having a power output; and a control circuit coupled to the motor, the control circuit including a power adjustment input for selecting the power output of the motor, and further including a range input for selecting a range of power outputs selectable by the power adjustment input.

24. A swing for an infant or child comprising:

a frame;

a first support arm suspended for swinging movement relative to the frame;

a seat operatively coupled to the first support arm for swinging movement through a travel distance along a path;

a support bar coupled to the seat, the support bar having a first end, the first end of the support bar telescoping with the first support arm to adjust the travel distance of the seat; and means for selectively securing the support bar to the first support arm at a first position and for selectively securing the support bar to the first support arm at a second position to adjust the travel distance of the seat.

25. A swing for an infant or child comprising:

a frame;

a first support arm suspended for swinging movement relative to the frame, the first support arm having a first longitudinal axis;

a seat operatively coupled to the first support arm for swinging movement through a travel distance along a path;

a support bar coupled to the seat, the support bar slidably engaging the first support arm such that the support bar is movable relative to the first longitudinal axis, wherein moving the support bar relative to the first longitudinal axis adjusts the travel distance of the seat; and means for selectively securing the support bar to the first support arm at a first position and for selectively securing the support bar to the first support arm at a second position to adjust the travel distance of the seat.

26. A swing for an infant or child comprising:

a frame;

a first support arm suspended for swinging movement relative to the frame;

a seat;

a support bar coupled to the seat, the support bar having a first end, the first end of the support bar telescoping with the first support arm such that the seat can be moved between a first height and a second height; and a second support arm suspended for swinging movement relative to the frame, the support bar having a second end telescoping with the second support arm.

27. A swing as defined in claim 26 wherein the support bar is U-shaped.

28. A swing for an infant or child comprising:

a frame;

a first support arm suspended for swinging movement relative to the frame;

a seat;

a support bar coupled to the seat, the support bar having a first end, the first end of the support bar telescoping with the first support arm such that the seat can be moved between a first height and a second height, wherein the first height is greater than the second height; and a clamp assembly for releasably securing the seat at the first height.

29. A swing as defined in claim 28 further comprising a first ledge associated with the first support arm and a second ledge associated with the support bar, wherein the first and second ledges cooperate to define the second height of the seat.

30. A swing as defined in claim 29 wherein the seat can be moved from the second height to the first height without releasing the clamp assembly.

31. A swing as defined in claim 28 wherein the clamp assembly comprises:

a bore defined in one of the first support arm and the support bar;

a spring button carried by a second one of the first support arm and the support bar, the spring button being dimensioned to mate with the bore to removably secure the seat at the first height; and an actuator positioned to selectively displace the spring button from the bore to release the seat for movement out of the first height.

32. A swing as defined in claim 31 wherein the clamp assembly further comprises a ring shaped housing, and the actuator is coupled to the housing.

33. A swing for an infant or child comprising:

a frame;

a first support arm suspended for swinging movement relative to the frame;

a seat;

a support bar coupled to the seat, the support bar having a first end, the first end of the support bar telescoping with the first support arm such that the seat can be moved between a first height and a second height; and a seat latch for selectively substantially securing the seat against swinging movement.

34. A swing as defined in claim 33 wherein the swing latch is operational when the seat is at the first height.

35. A swing for an infant or child comprising:

a frame;

a first support arm suspended for swinging movement relative to the frame, the first support arm having a first longitudinal axis;

a seat;

a support bar coupled to the seat, the support bar slidably engaging the first support arm such that the support bar is movable relative to the first longitudinal axis, wherein moving the support bar relative to the first longitudinal axis adjusts a height of the seat; and a second support arm suspended for swinging movement relative to the frame, the second support arm having a second longitudinal axis, and the support bar slidably engaging the second support arm such that the support bar is simultaneously movable relative to the first and second longitudinal axes to adjust the height of the seat.

* * * * *